US008893450B2

(12) United States Patent
Zohar

(10) Patent No.: US 8,893,450 B2
(45) **Date of Patent: *Nov. 25, 2014**

(54) METHODS AND DEVICES FOR MAKING A BUILDING BLOCK FOR MORTAR-FREE CONSTRUCTION

(76) Inventor: Ron Zohar, Rehovot (IL)

( * ) Notice: Subject to any disclaimer, the term of this patent is extended or adjusted under 35 U.S.C. 154(b) by 0 days.

This patent is subject to a terminal disclaimer.

(21) Appl. No.: 13/697,528

(22) PCT Filed: Mar. 4, 2012

(86) PCT No.: PCT/IL2012/050067
§ 371 (c)(1),
(2), (4) Date: Nov. 13, 2012

(87) PCT Pub. No.: WO2012/153328
PCT Pub. Date: Nov. 15, 2012

(65) Prior Publication Data

US 2013/0227901 A1 Sep. 5, 2013

(51) Int. Cl.
*E04B 5/48* (2006.01)
*E04C 2/20* (2006.01)

(52) U.S. Cl.
USPC ..... 52/606; 52/503; 52/561; 52/604

(58) Field of Classification Search
USPC ..... 52/503–505, 596–599, 600–607, 52/309.15, 309.4, 311.1, 426; 446/120, 446/127–128, 109–111; 405/262, 284, 286
See application file for complete search history.

(56) References Cited

U.S. PATENT DOCUMENTS

| | | | | | |
|---|---|---|---|---|---|
| 2,173,020 | A * | 9/1939 | Kubach | 52/591.2 |
| 3,440,788 | A * | 4/1969 | Merget | 52/405.2 |
| 4,041,670 | A * | 8/1977 | Kaplan | 52/592.2 |
| 4,060,952 | A * | 12/1977 | Hernandez | 52/591.2 |
| 4,388,361 | A * | 6/1983 | Vassalli | 428/192 |
| 4,426,815 | A * | 1/1984 | Brown | 52/100 |
| 5,471,808 | A * | 12/1995 | De Pieri et al. | 52/603 |
| 5,596,855 | A * | 1/1997 | Batch | 52/309.11 |
| 5,615,529 | A * | 4/1997 | Johnson et al. | 52/604 |
| 5,788,423 | A * | 8/1998 | Perkins | 405/284 |
| 6,062,772 | A * | 5/2000 | Perkins | 405/284 |
| 6,122,880 | A * | 9/2000 | Kolb et al. | 52/592.6 |
| 6,265,657 | B1 * | 7/2001 | Layne | 174/50 |
| 6,571,525 | B2 * | 6/2003 | Coleman | 52/592.5 |
| 6,722,094 | B1 * | 4/2004 | Judd et al. | 52/404.1 |
| 7,254,924 | B2 * | 8/2007 | Regina | 52/306 |
| 7,395,999 | B2 * | 7/2008 | Walpole | 249/33 |
| 7,694,485 | B1 * | 4/2010 | Siener | 52/590.2 |
| 7,854,573 | B2 * | 12/2010 | Knudson et al. | 405/284 |
| 8,578,669 | B2 * | 11/2013 | Zohar | 52/220.1 |

(Continued)

FOREIGN PATENT DOCUMENTS

| | | | |
|---|---|---|---|
| EP | 367334 A | * | 5/1990 |
| WO | WO 2005061233 A1 | * | 7/2005 |

*Primary Examiner* — Jeanette E. Chapman

(57) ABSTRACT

The invention discloses devices and methods for using building blocks for construction that does not require mortar, internal columns or additional internal or external finishing. A building block includes joining elements for attaching blocks from top to bottom as well as from side to side. Additionally, blocks have internal and external finishes that are complete. The block includes a removable face for allowing access to space for infrastructural elements like wires and pipes. Thus, after construction of a structure, there is no additional need to paint, hang wallpaper or otherwise treat the outer and inner walls of the final structure.

17 Claims, 26 Drawing Sheets

(56) References Cited

U.S. PATENT DOCUMENTS

2002/0152709 A1* 10/2002 Gresser et al. ..... 52/604
2004/0191434 A1* 9/2004 Correia ..... 428/34.1
2008/0184649 A1* 8/2008 Khan ..... 52/592.6
2010/0223876 A1* 9/2010 Jones ..... 52/588.1
2010/0311299 A1* 12/2010 Rath ..... 446/87
2012/0295143 A1* 11/2012 Schaefer ..... 429/72

* cited by examiner

METHODS AND DEVICES FOR MAKING A BUILDING BLOCK FOR MORTAR-FREE CONSTRUCTION

FIELD AND BACKGROUND OF THE INVENTION

The present invention, in some embodiments thereof, relates to methods and components for preparing a building block for mortar-free construction. In some embodiments, building blocks are described that have unique finishes and features for home, office, factory or other construction based on a single or plurality of pre-made blocks that together provide walls with complete internal and external finishes.

One of the most basic necessities form mankind is housing. People need a place to live and a home is oftentimes the biggest investment that an individual or family will ever make. Home construction varies throughout the world, though the basic requirements of keeping the elements out and allowing for successful living within are true everywhere.

The prior art generally describes blocks and methods for constructing structures using pre-made building blocks of various materials that do not include pre-made internal and external final finishes.

SUMMARY OF THE INVENTION

It is therefore a purpose of the present invention, in some embodiments, to describe methods and devices for building structures with a single or small set of unique building blocks that have all the features required for on-site complete construction and use as provided without any further action such as painting, wall-papering or adding siding. In some embodiments of the invention, hollow interiors of building blocks allow for passage of pipes, wires, and the like.

The invention includes a substantially hollow block for the mortar-less and column-less construction of a structure, wherein the block has a top side that includes a first joining feature, a bottom side including a complementary second joining feature, an outer side having a first finish, an inner side having a second finish, a plurality of connectors at the ends of the block, and an inner space closed by a transiently removable face, the space adapted to accept infrastructure elements.

In one aspect of the block, the first joining feature is a plurality of joining features, and wherein the second joining feature is a plurality of joining features.

In another aspect of the block, the joining features include at least one strip of two-sided tape.

In another aspect of the block, the joining features include at least one male joining feature and at least one female joining feature.

In another aspect of the block, the building is a house, room, office, factory, school, hospital, public structure, sky scraper or private building or room.

In another aspect of the block, the insulation and energy saving materials placed inside the space.

In another aspect of the block, the infrastructure elements are selected from piping, wiring, cables, or telephone lines.

In another aspect of the block, the first finish is weatherproofed and selected from paint, wood, brick, aluminum siding, stone, glass, composite materials, metal.

In another aspect of the block the second finish is selected from paint, wallpaper, stone, wood, brick, aluminum, glass, metal, composite materials, or drywall.

In another aspect of the block, the first finish and the second finish are identical.

In another aspect of the block, the face is transiently removed by the aid of a vacuum.

The invention includes a method for building a structure without mortar or internal columns, including the following: selecting a site for construction of a structure; pouring concrete over at least a portion of the site of construction; placing a first plurality of building blocks in a line, wherein the line defines the base of a wall of the structure and wherein the blocks have top sides that includes first joining features, bottom sides including a complementary second joining features, connectors for side-to-side connections between blocks, and inner hollow spaces including transiently removable faces, the spaces adapted to accept infrastructure elements; placing a second plurality of building blocks on top of the first plurality of building blocks, wherein the second plurality of building blocks are secured to the first plurality of building blocks through joining features and double-sided tape; adding additional building blocks until a predetermined height of the wall has been reached; placing a closure element over the highest level of blocks so as to lock all blocks associated with the wall in place and to form a ceiling; building additional walls of the structure, including internal walls through appropriately adapted connectors; and, completing construction of the structure, wherein the blocks are used in the construction of the internal and external load-bearing walls of the structure.

In one aspect of the method, the building blocks are a plurality of building blocks with different structural, thermal, optical or aesthetic properties.

In another aspect of the method, the building blocks include elements to accept prefabricated windows or doors.

In another aspect of the method, the building blocks include blocks that may be used in building of a roof.

The invention additionally includes a building block for mortar-less and paint-less construction, wherein the block is made of a pre-painted polymeric material and includes a plurality of elements for self-joining with other such building blocks as well as a face that can be transiently removed by vacuum force for access to infrastructure elements within the building block.

In one aspect of the block, the building block includes spaces for passing through electrical wiring, pipes, tubes, cables and telephone lines.

In another aspect of the block, the elements for self-joining allow for contact between blocks, wherein the contact does not allow for passage of wind or rain.

In another aspect of the block, the block includes at least one male and at least one female joining element as well as one connector at each end.

In another aspect of the block, the building block is used for the construction of walls, floors, ceilings, and roof of a multistory column-free home.

The invention includes a method for constructing a multistorey structure without internal columns, including the following: selecting a site for construction of a structure; preparing a floor from a plurality of prefabricated blocks and finished floor pieces, wherein the blocks have complementary joining features on their sides as well as joining features for securely holding the finished floor pieces; placing a first plurality of building blocks in a straight line over the floor, wherein the line defines a wall of the structure and wherein the blocks have top sides that includes first joining features, bottom sides including a complementary second joining features, connectors for side-to-side connections between blocks, and inner spaces including removable faces, the spaces adapted to accept infrastructure elements; placing a second plurality of building blocks on the first plurality of building blocks, wherein the second plurality of building blocks are secured to the first plurality of building blocks through joining features and double-sided tape; adding additional building blocks until a predetermined height of the wall has been reached; placing a ceiling over the blocks, wherein the ceiling is prepared from blocks with joining elements adapted to join with elements from the highest blocks of the wall; laying flooring pieces over the ceiling to form a floor of a second storey; building additional walls of the structure above the floor; repeating steps of erecting a ceiling and building additional walls above the ceiling; and, completing construction of the structure, wherein the blocks are used in the construction of all internal and external walls of the structure, as well as floors, ceilings and roof of the structure of a predetermined number of stories.

The invention includes a block system for construction of a structure, including the following: a plurality of building blocks, the blocks prepared from polymeric materials and including a transiently removable face for access to a hollow space for infrastructure elements; a closing element, wherein the closing element is adapted to fit within joining elements associated with a plurality of the building blocks stacked upon each other; and, glue, wherein the glue is applied between adjacent building blocks to hold together the building blocks.

Unless otherwise defined, all technical and/or scientific terms used herein have the same meaning as commonly understood by one of ordinary skill in the art to which the invention pertains. "Plastic" as applied to materials used in construction of a building block may include any type of synthetic material, polymer, composite material or combinations of synthetic and natural materials. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. It is noted that similar elements in various drawings will have the same number, advanced by the appropriate multiple of 100.

In the drawings:

FIGS. 8A-8B shows a schematic view of a building block according to the instant invention adapted for passage of wires, pipes or the like;

DESCRIPTION OF SPECIFIC EMBODIMENTS OF THE INVENTION

The present invention, in some embodiments thereof, relates the manufacture and use of building blocks, wherein said building blocks require no mortar for construction and are may be prepared with internal and external finishes so as to obviate any requirement for painting or further manipulation post-construction. A structure built according to embodiments of the present invention will have no requirement for internal columns. Most terms herein employed may have their normal meanings as understood in the relevant arts. Some terms unique to the instant invention are herewith further defined. "Connectors" may generally refer to elements, often male and female, placed at the ends of blocks to allow for their facile connection. A typical block may have a male connector at one end, a female connector at another end, and independently, a plurality of male joining elements on its top and a plurality of complementary female joining elements on its bottom. Ceiling and floor elements may include connectors as well as joining elements on one or a plurality of sides. Some blocks may include three or more sets of connectors to allow for construction of internal spaces in a building. "Vacuum force" may refer to the use of a vacuum-based device for removing a face covering space set aside for infrastructure elements in a block. A "closing element" may generally be a component that may be placed in joining elements of a plurality of blocks so as to hold the blocks tightly in place. A closing element may generally have a shape similar to the shape of the joining elements and it may also include threading to allow for screwing the closing element into place when holding a plurality of blocks together. It is understood that blocks as described in the following embodiments may be made of any relevant materials or combinations of materials. Concrete, carbon fibers, sand, chalk, metal, glass, marble, carbon composites, stone, and plastics are all non-limiting examples of materials that may be used either for constructing blocks or for combination in the construction of blocks used as per the instant invention.

Figure 1A:
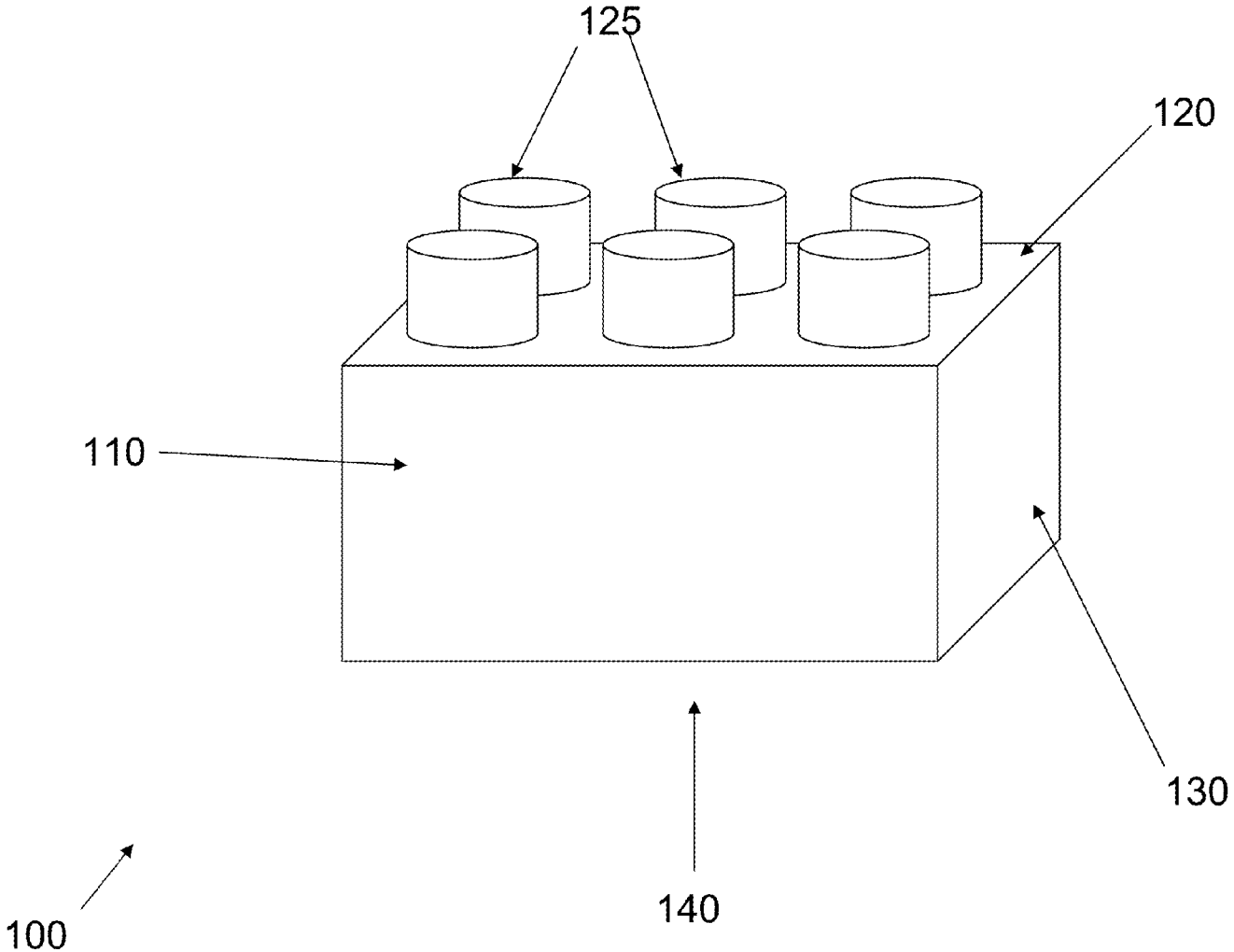
FIGS. 1A-1C are schematic views of building blocks according to some embodiments of the present invention.

For purposes of better understanding some embodiments of the present invention, as illustrated in FIGS. 1-19 of the drawings, reference is first made to FIG. 1A.

First Embodiment

FIG. 1A shows a building block 100 including an internal side 110 that faces inwards in a structure, an external side (not visible in figure), two joining sides 130 as well as a top side 120 including joining elements 125 and a bottom side 140. The block 100 may be made of any material, though polymers are preferred. The block is generally hollow in its construction and may be of any size or dimension desired. The joining elements 125 are shown here schematically and may be of number, shape, and size as required for optimal use. A block 100 is generally joined with identical blocks on its joining sides, where there may or may not be adhesive or other connection. Additional blocks may be attached from top and/or bottom through the agency of joining elements 125 so as to build up a wall of a building structure.

Figure 1B:
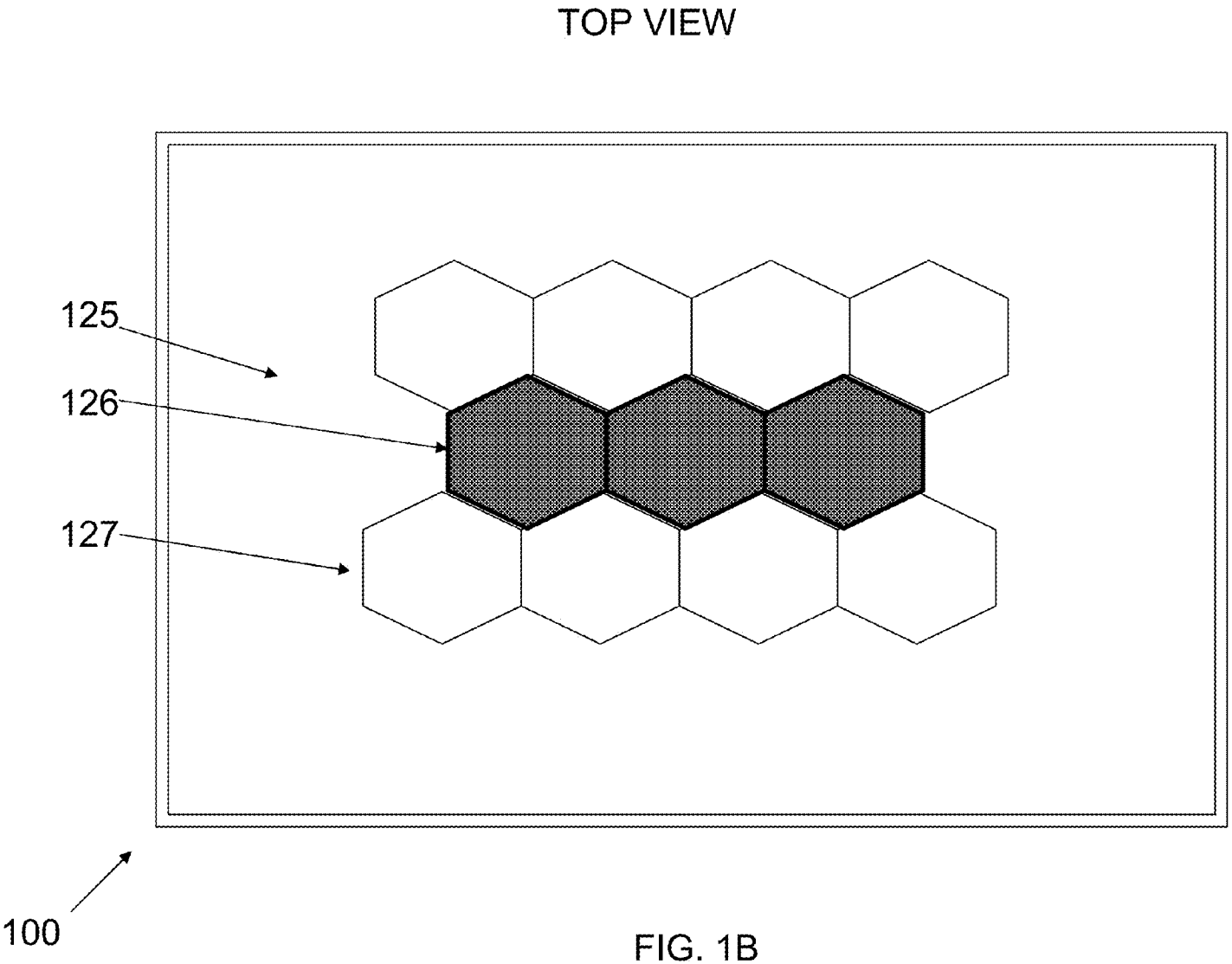
Figure 1C:
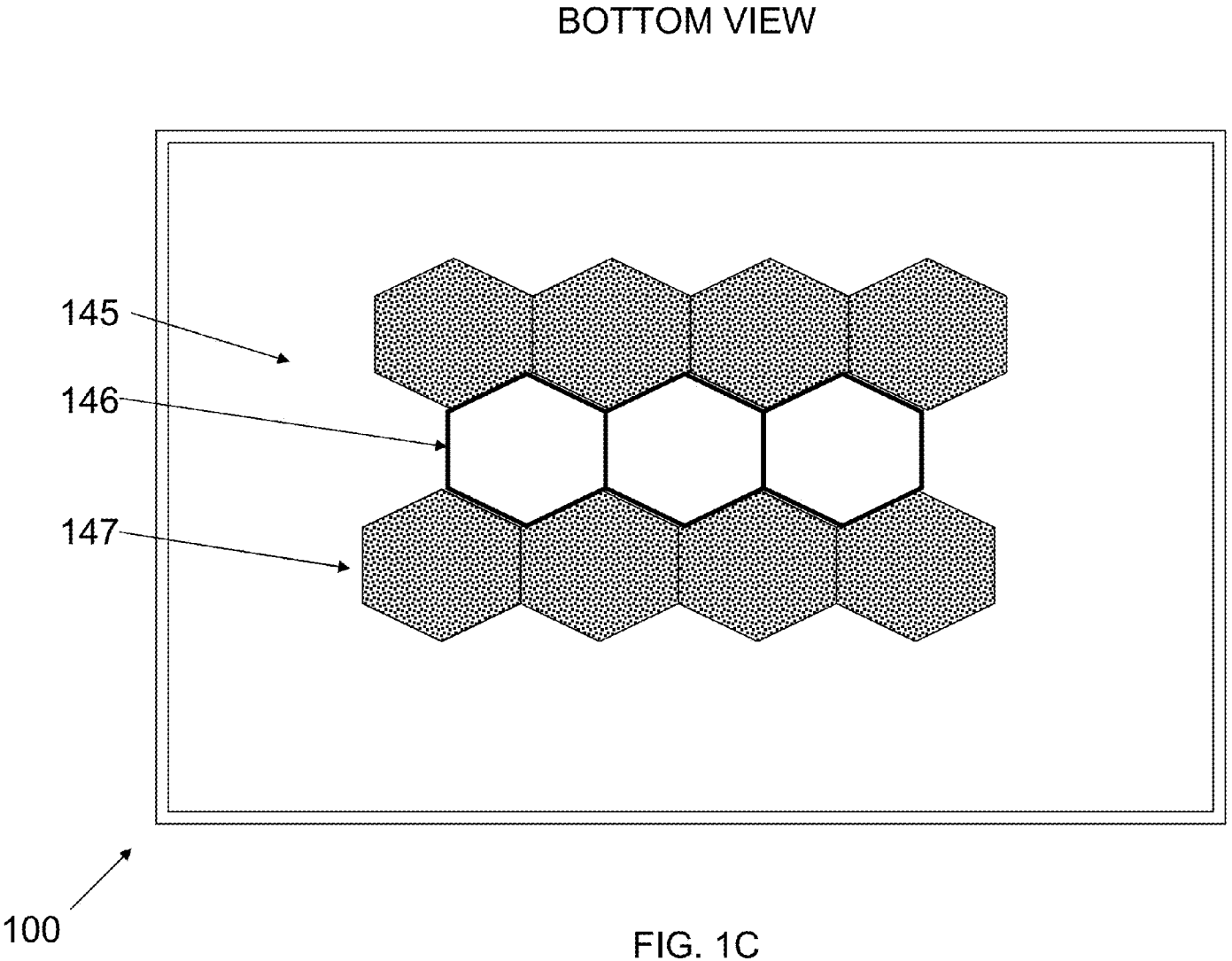

FIG. 1B shows a top view of a building block 100 in which the joining elements 125 are arranged in a honeycomb shape that includes protruding 126 and receding 127 elements. This physical arrangement allows for optimal joining of blocks 100, one on top of another. FIG. 1C shows a complementary bottom side 140 with joining elements 145 that are complementary to the joining elements (125, FIG. 1B) both in shape and physical arrangement. Namely, receding 146 and protruding 147 honeycomb elements allow for very tight block to block attachment.

Second Embodiment

Figure 2A:
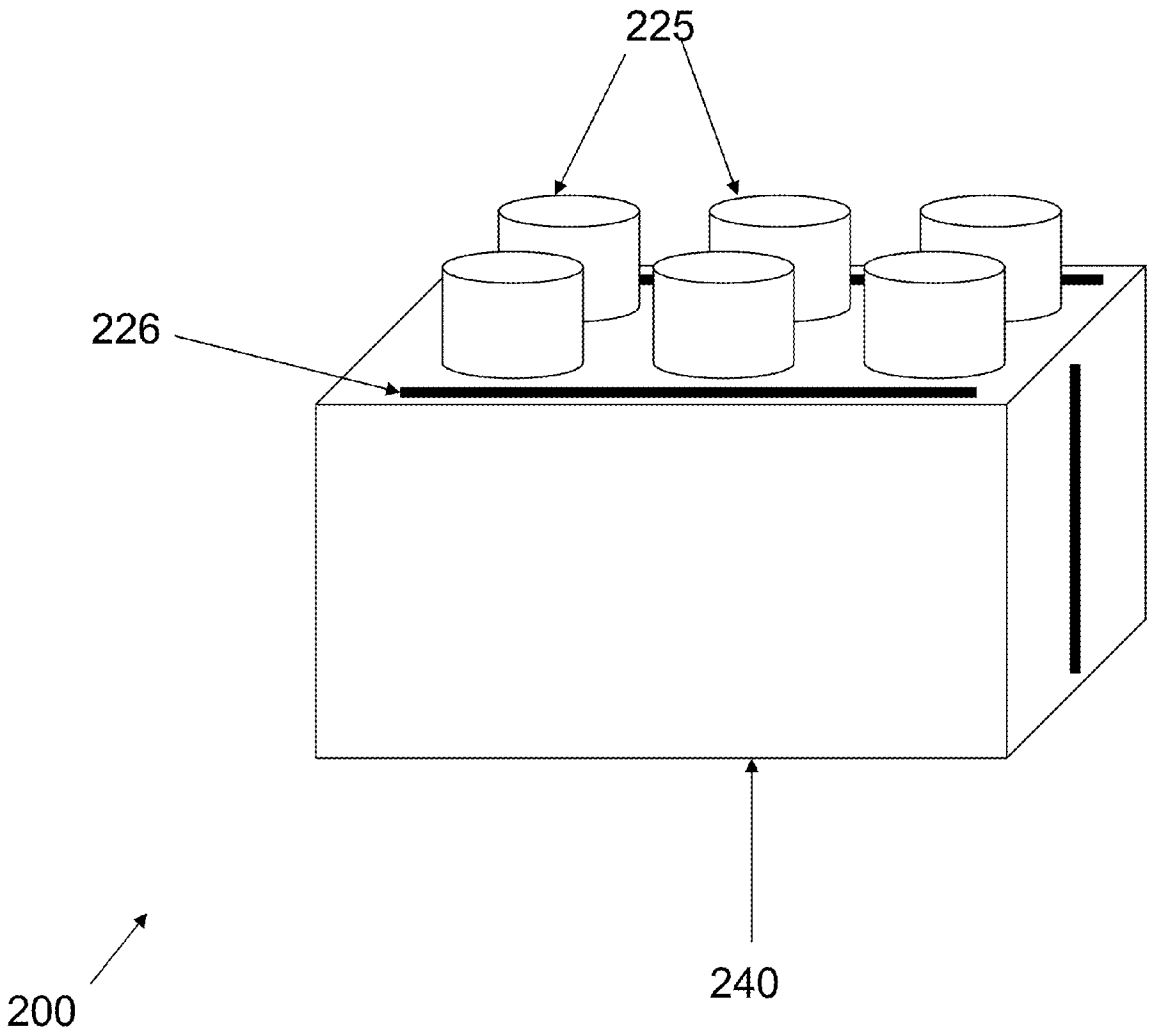
FIGS. 2A-2B are schematic views of an alternative embodiment of the present invention.
Figure 2B:
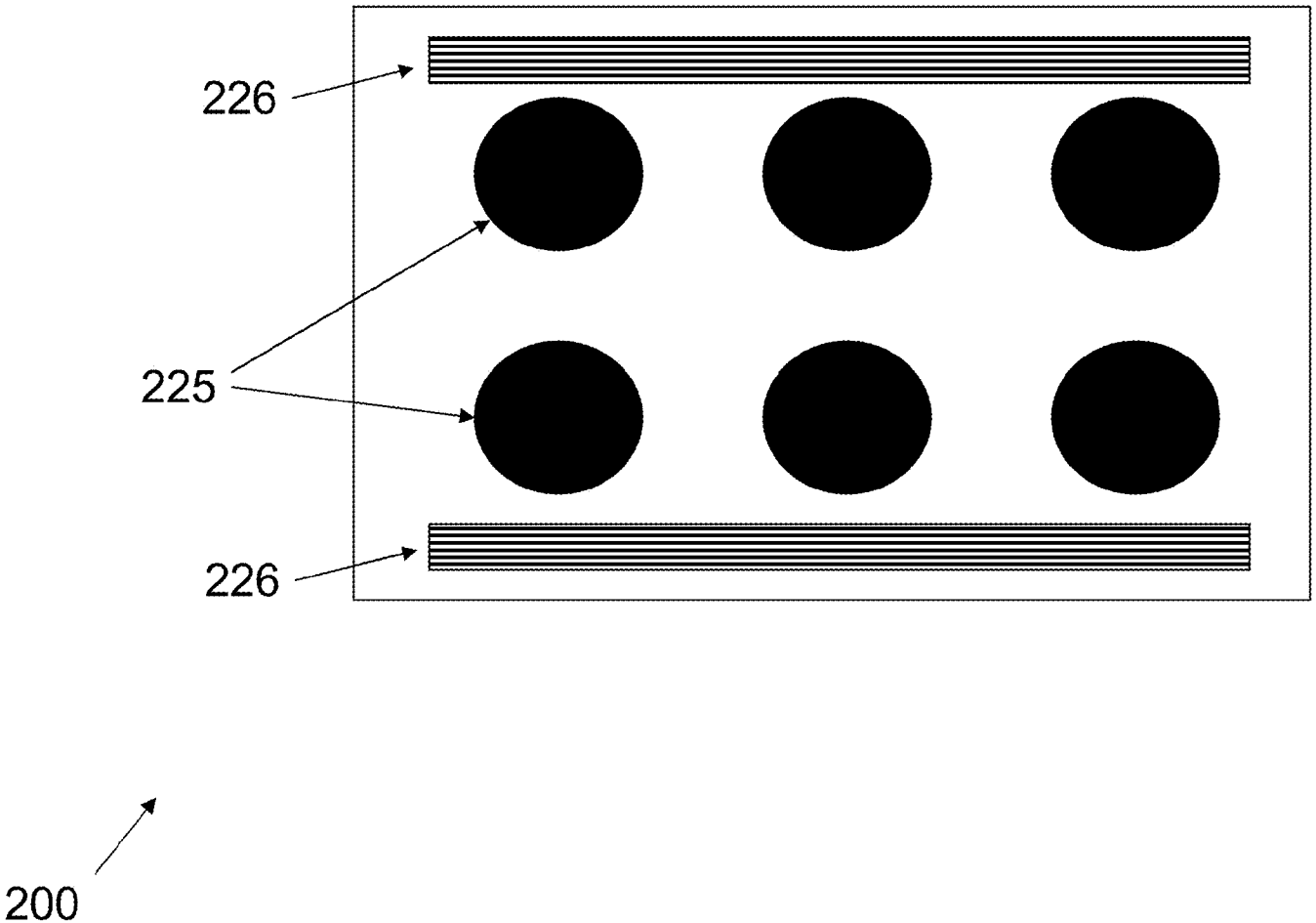

Attention is turned to FIG. 2A, which shows a building block 200 further including two-sided strong adhesive tape 226 applied to the top of said block 200 and in proximity to joining elements 225. The tape 226 is applied to the block 200 during manufacture and the second adhesive side of the tape 226 is exposed at a time of construction. Two sided tape 226 allows for very strong and nearly irreversible joining of building block 200 to a second building block (not shown). FIG. 2B shows a top view of the tape 226 as applied adjacent to joining elements 225. Two strips of tape are shown for example purposes only, and any number of pieces of tape of any appropriate size and dimensions may be utilized in the instant invention.

Figure 3:
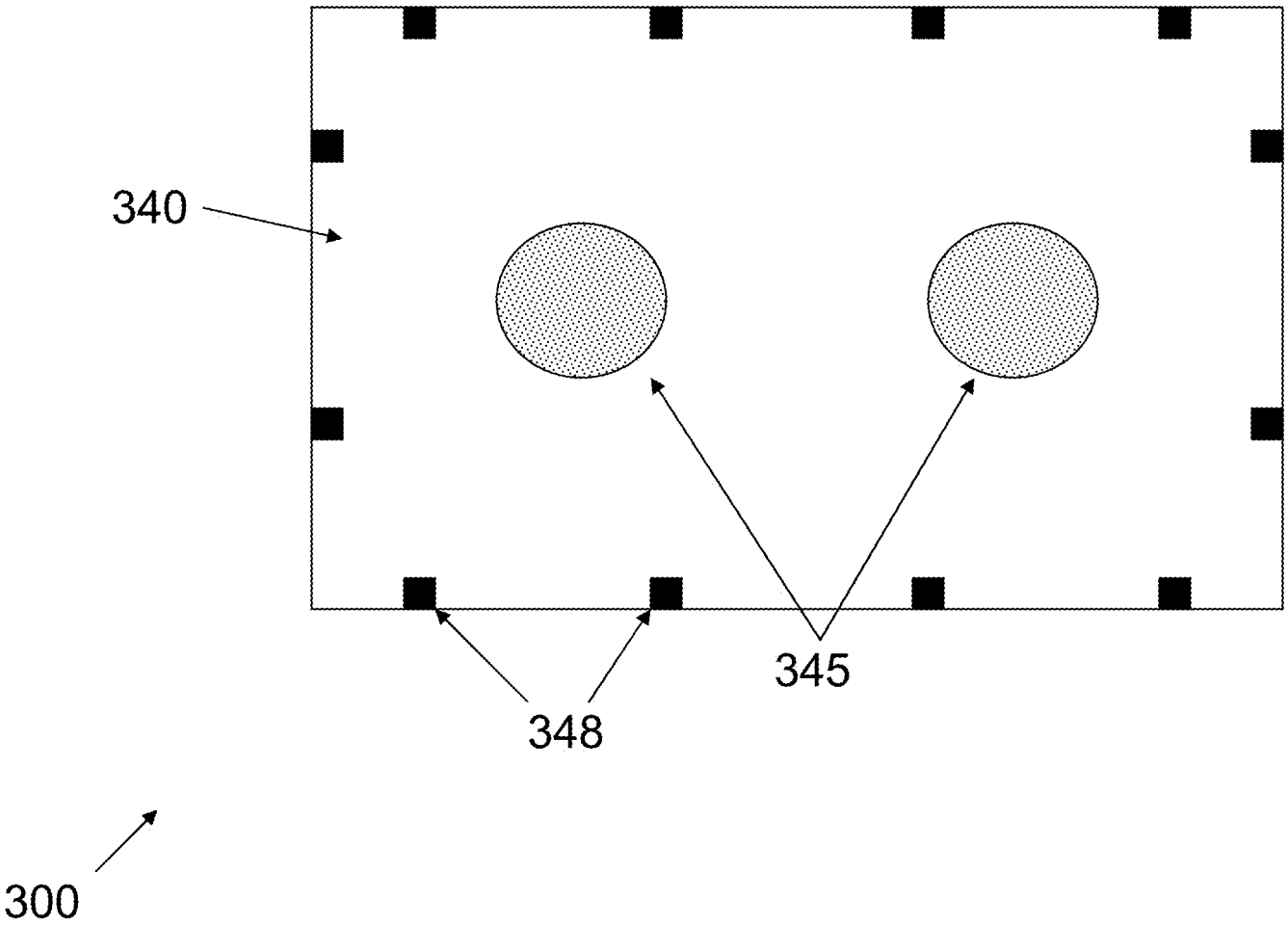
FIG. 3 shows a schematic bottom view of a building block according to an embodiment of the present invention.

Attention is now turned to FIG. 3 which shows a bottom 340 region of a building block 300 according to the present invention. The bottom 340 may include joining elements 325 as well as pins 348 or other elements that aid in either stabilizing block-block binding and/or allow for better fit between successive blocks. It is noted that the two-sided tape (226, FIG. 2) binds top and bottom (340, FIG. 3) regions of a block 300 in addition to joining elements which both join and align building blocks 300.

Third Embodiment

Figure 4:
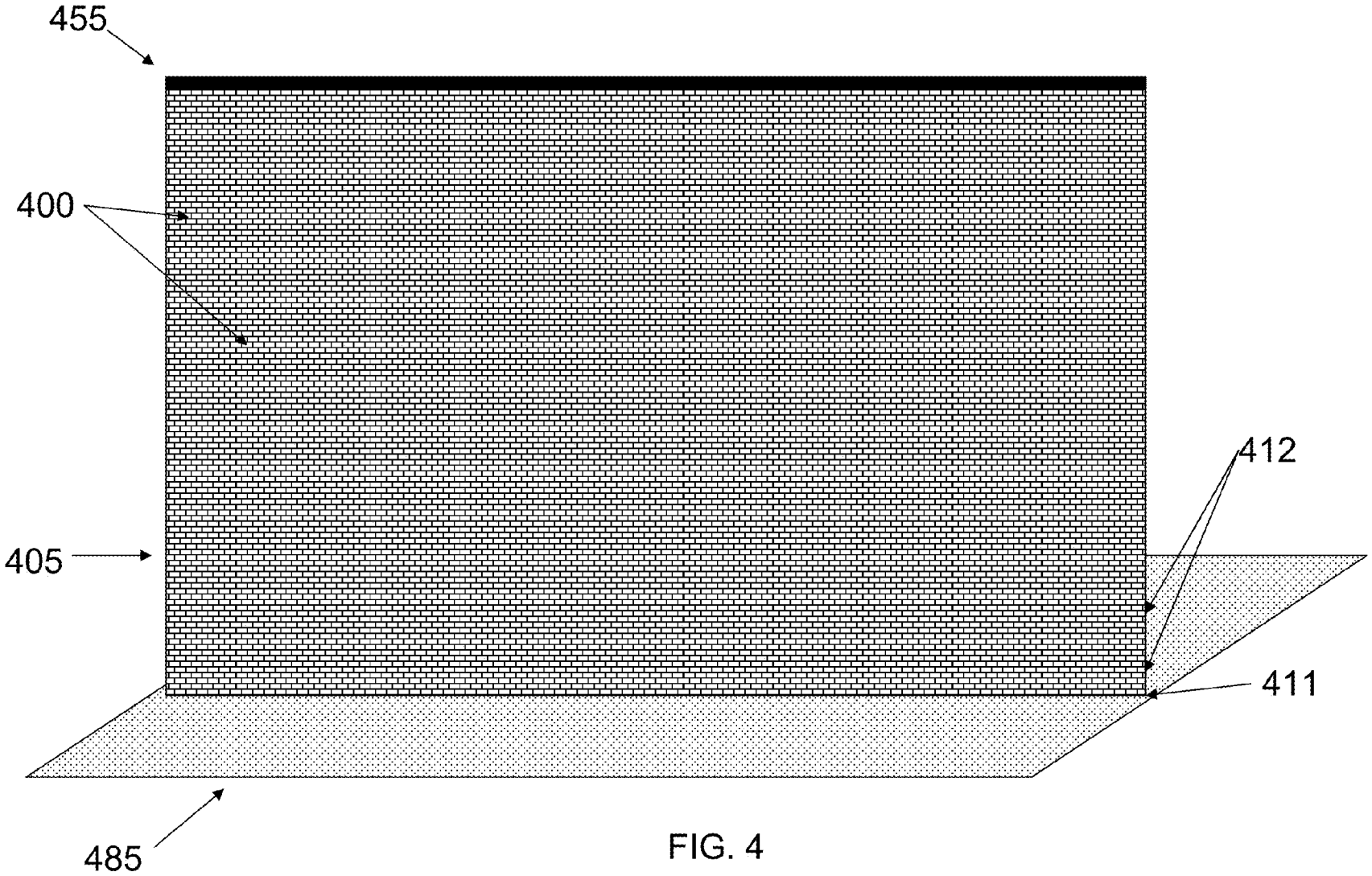
FIG. 4 shows a schematic view of a wall built with a plurality of building blocks prepared according to an embodiment of the present invention.

Attention is turned to FIG. 4. Blocks from the instant invention may be used in the construction of single-unit or multi-unit housing projects. In FIG. 4, a concrete foundation 485 is poured over a predetermined building area. Individual building blocks 400 are used to form a first row 411 of blocks 400. The blocks 400 can be secured to the concrete foundation 485 by any means including but not limited to two-sided tape. The blocks 400 of the first row 411 also can be held together through side-mounted double-sided tape (not shown) or other appropriate prefab binding elements. Additional rows 412 are added, with blocks from additional rows sitting above blocks 400. Joining elements as previous described assist in the tight linking of successive rows of blocks 400 to the desired height of the wall 405. At the top of the wall 405 is placed a closure element 455 which sits above the last row of blocks 400. The closure element 455 serves to secure the final row of blocks 400 and the entire wall 405 as constructed of individual prefab blocks 400. The wall 405 is just one part of a larger structure (not shown), but it is constructed without recourse to mortar. Additionally, the inner and outer surfaces are already painted or otherwise prepared so as to be in their final state. The wall 405, once constructed, requires no further treatment or manipulation.

Figure 5:
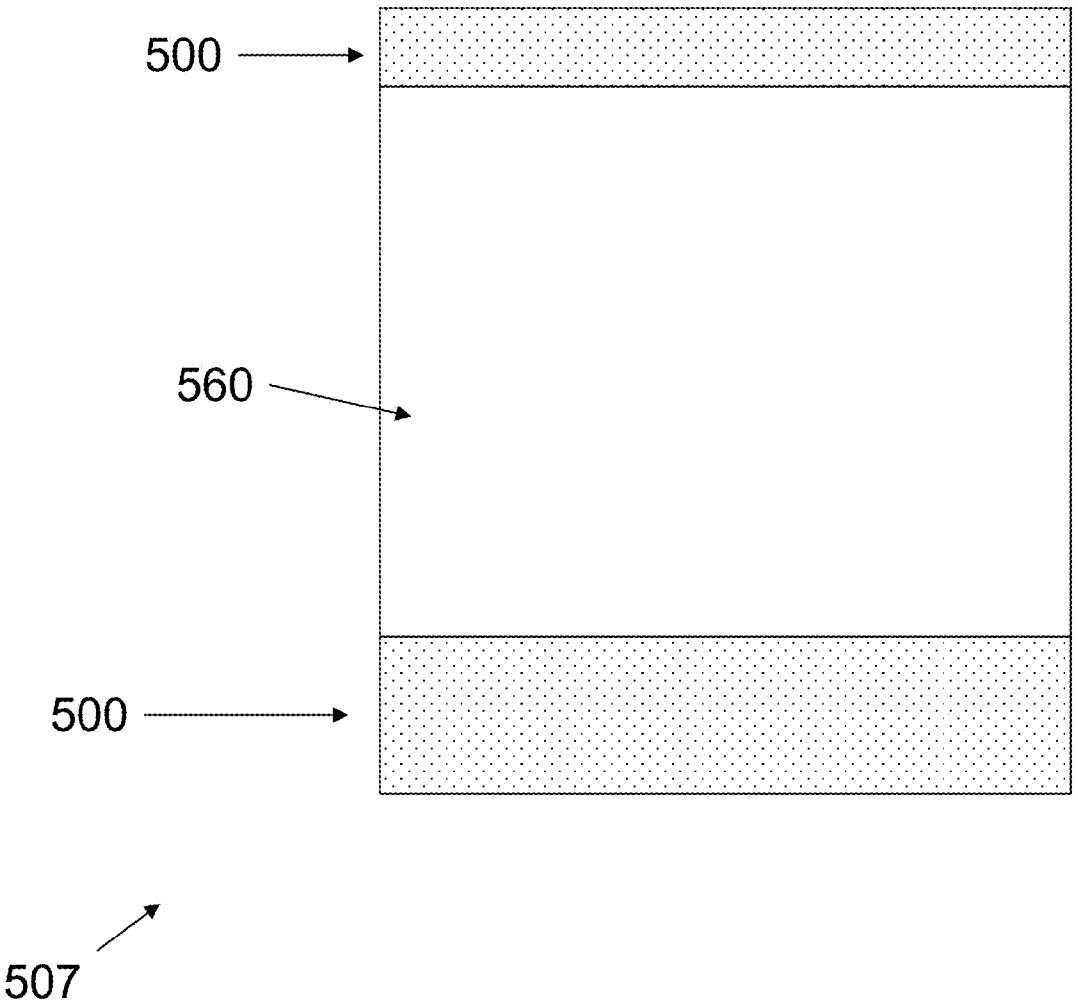
FIG. 5 shows a schematic view of unique inner and outer finishes on a building block according to an embodiment of the present invention.

Attention is turned to FIG. 5 which shows a window 507 as prepared according to the present invention. In the wall (FIG. 4, 405) previously described, no window was present. Obviously, any housing structure must have light and air access. Thus, windows, doors, and the like must be present. The window (FIG. 5, 507) may be built to any size or specification. Generally, there will be a block 500 on the bottom, glass 560 in the middle and another block 500 on the top. The blocks 500 do not have to be the same size or even of the same material. The glass 560 can be any appropriate material and may be tinted and/or have opening/closing features. The window 507 is integrated into a wall (not shown) through the attachment of the upper and lower blocks 500 to additional blocks (not shown) comprising the wall. Thus, windows, doors and other construction elements can be incorporated into buildings, whereby building blocks 500 are incorporated to facilitate insertion of windows, doors and the like into walls comprised of regular building blocks as described in FIGS. 1 & 2.

Fourth Embodiment

Figure 6:
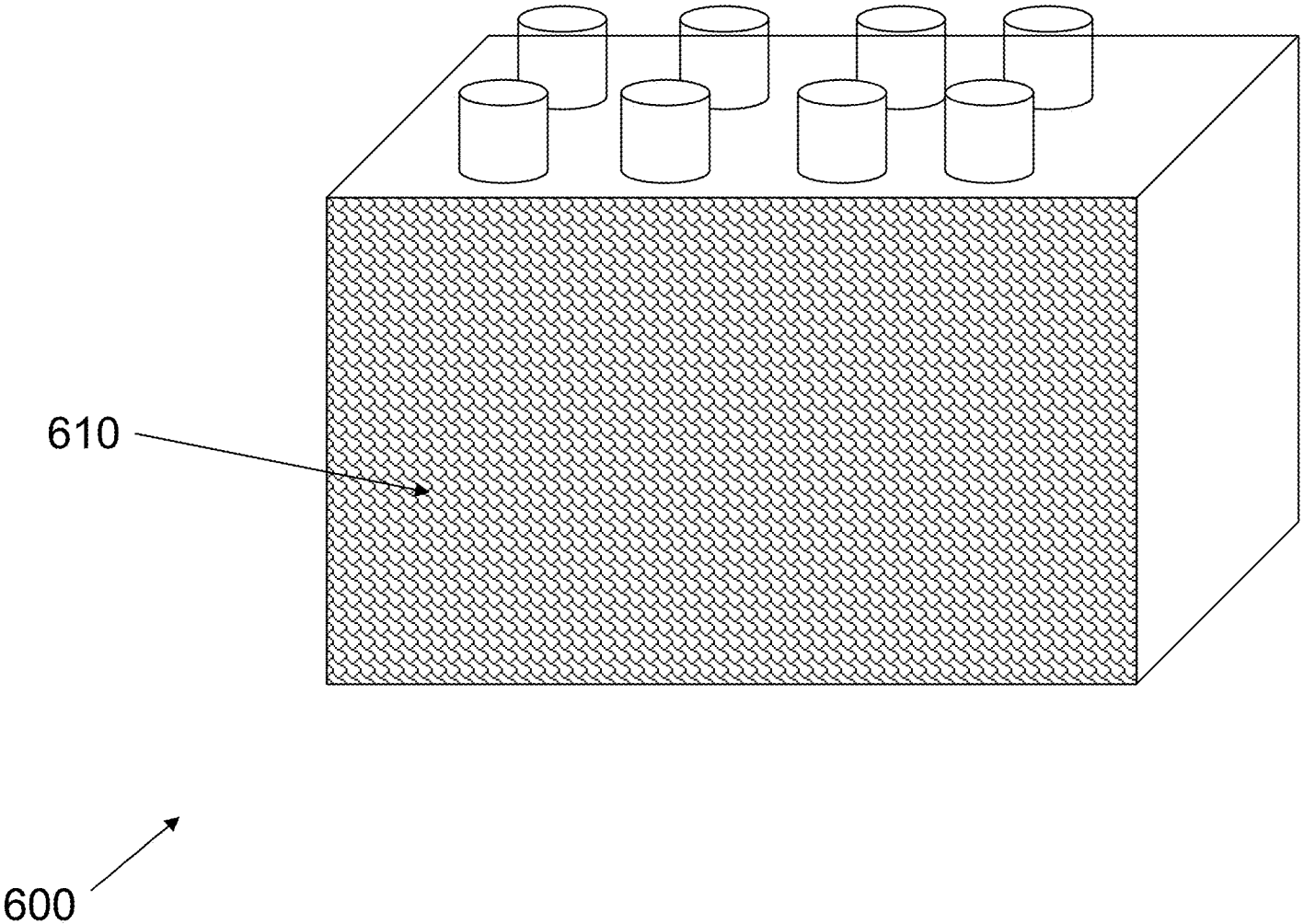
FIG. 6 shows a schematic view of a building block according to the instant invention and its prefab exterior surface.

Attention is turned to FIG. 6 which shows an embodiment of the present invention. A block 600 includes an inner coating 610 which is prepared prior to insertion of the block 600 into a building structure. The inner coating 610 may be paint, wall-paper, tiles, dry-board or any material used for decorative or functional purposes. By having an inner coating 610 present on block 600 prior to building, one does not require additional treatment of block 600 after construction. When construction is complete, a wall (not shown) has a complete, ready inner side that may appear painted, covered in wallpaper or otherwise decorated as a wall in a traditional house or building would be decorated.

Figure 6B:
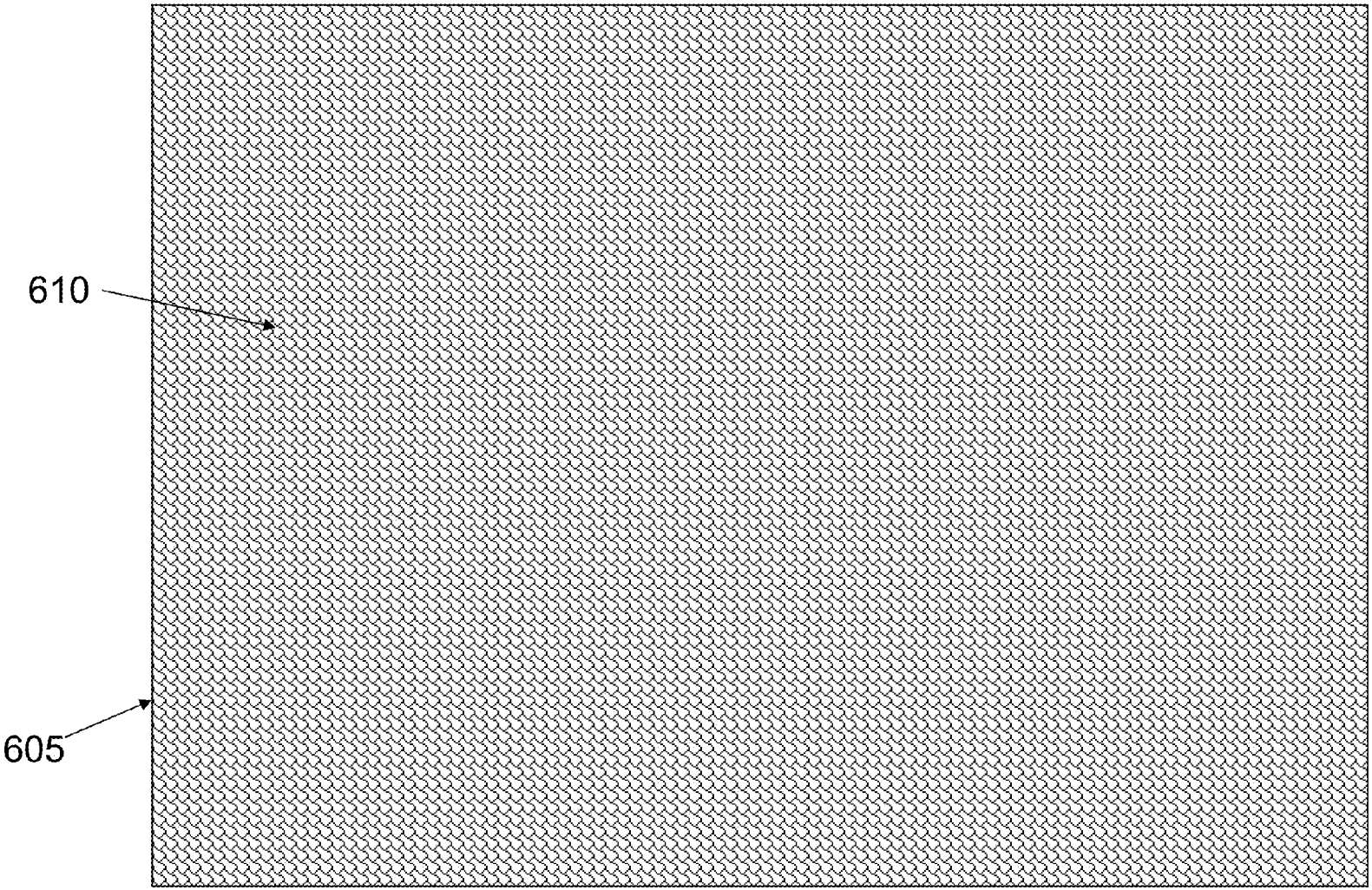

FIG. 6B shows a completed wall 605 with the inner coating 610 over the entire wall 605. In the figure, only one block type was used. It is obvious that a plurality of different blocks having different inner coatings may be employed to give predetermined designs or effects.

Figure 7A:
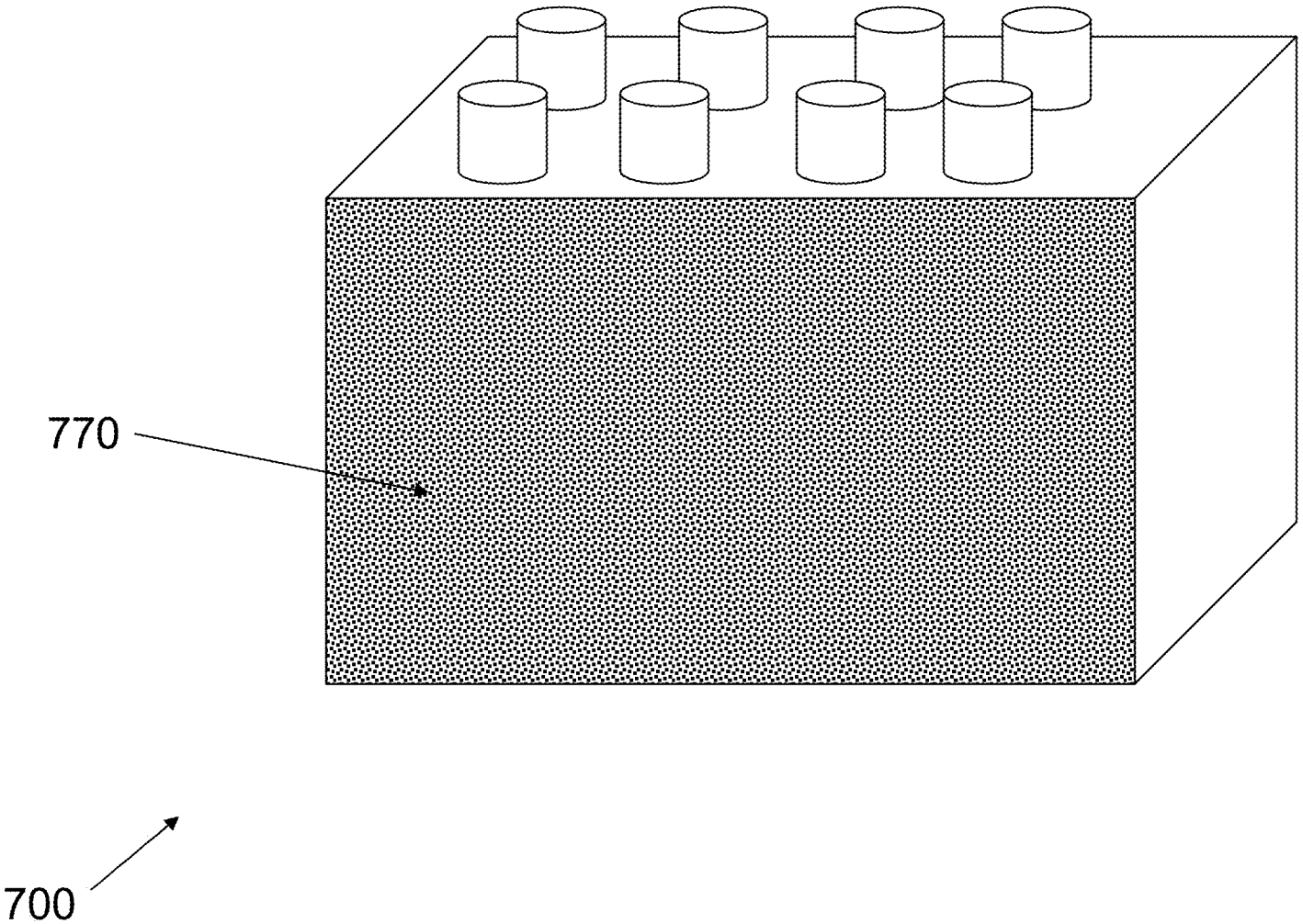
FIG. 7 shows a schematic view of a building block according to the instant invention and its prefab interior surface.
Figure 7B:
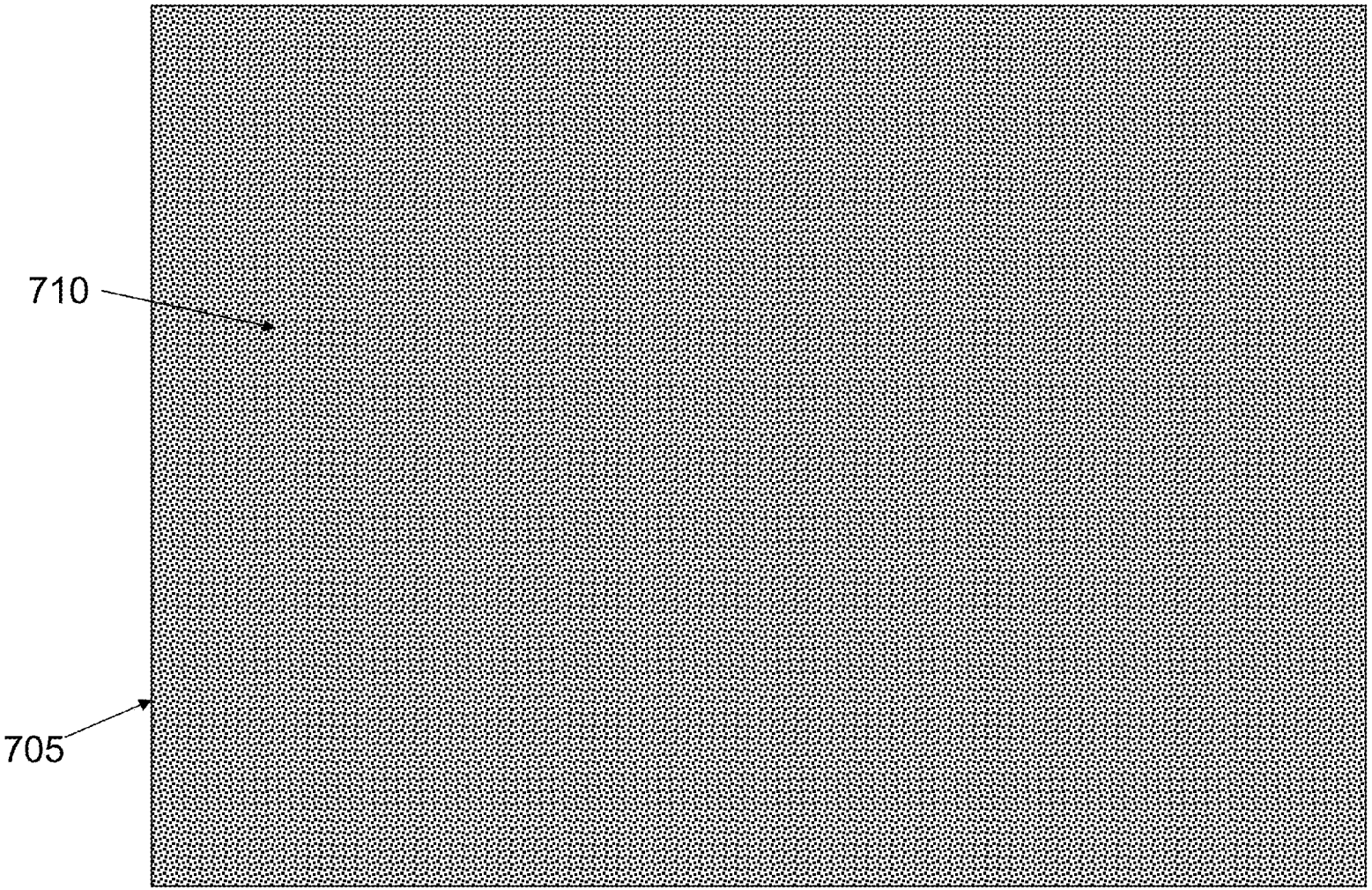

In FIG. 7A, one sees a schematic view of a block 700 which includes an outer coating 770 that is prepared prior to block 700 use and is generally made from materials that would be typically present on the outer face of a structure: paint, siding, stucco, brick façade, stone façade, wood, or the like. The block 700 is prepared with the outer coating 770 ready from the factory so that one hiring a builder would choose which outer coating he/she wishes to have at different points in the final, built structure (not shown). Ostensibly, a builder would have a catalogue of standard production blocks 700 that are available with a wide range of different outer coatings 770 and inner coatings (FIG. 6B, 610). A consumer or client would choose the inner and outer coatings desired either for the entire structure or in a room-by-room manner and the supplier or contractor would deliver for use ready pre-made blocks that have full construction capability as well as the desired inner and outer finishes. As such, no mortar, paint, siding, wallpaper or the like must be used after construction. After building has been completed, no further finishing work is required. Obviously, if one wishes to add paint, wallpaper or the like, he/she can do so. But with the instant invention, there would be no further requirement to do so. FIG. 7B shows a final wall 705 with a complete outer coating. While the lines between blocks (not shown) might be visible, the engineering of the blocks allows for minimization of the lines between blocks or their cover with the outer coating or inner coating (FIG. 6B, 610).

Fifth Embodiment

Figure 8A:
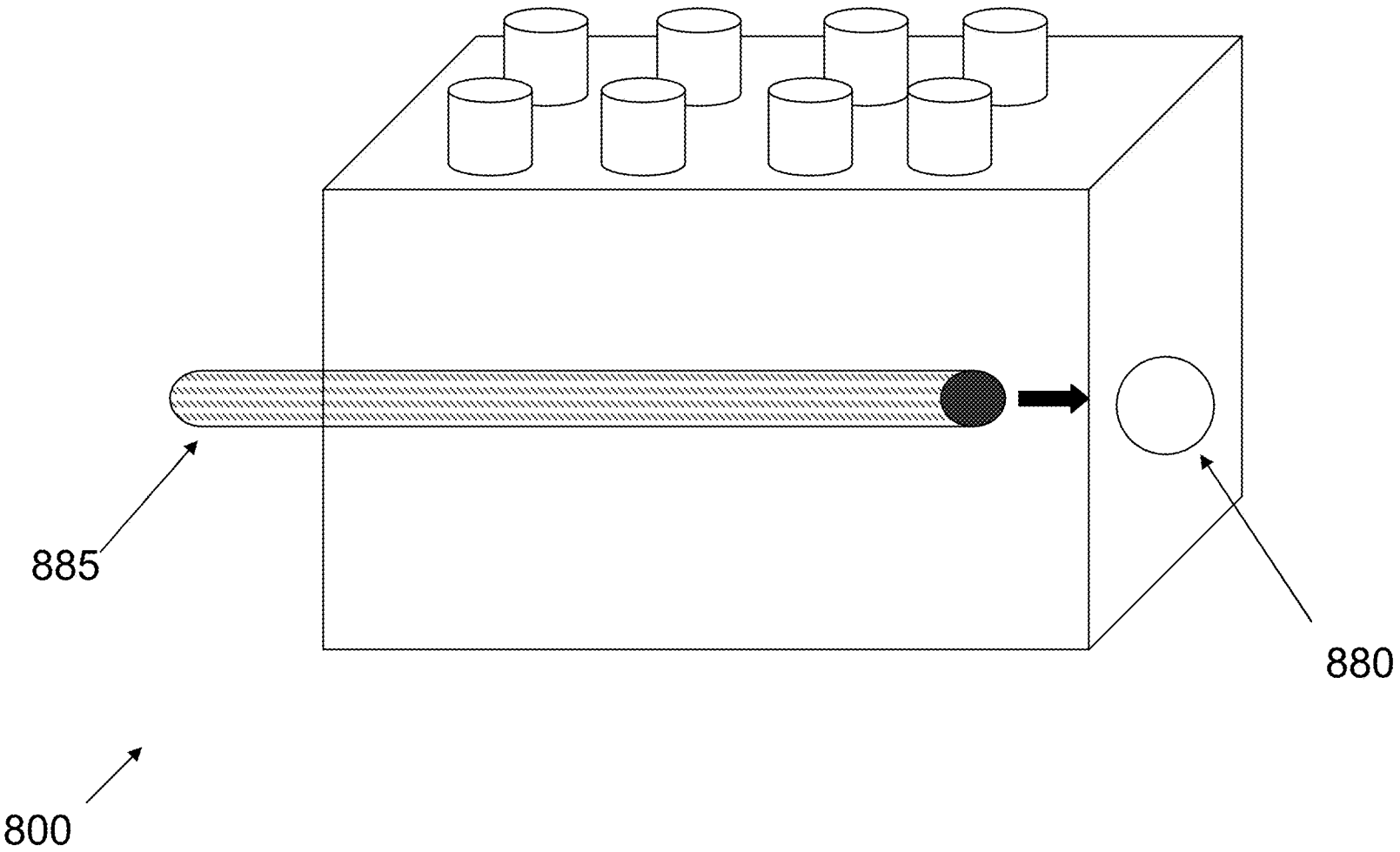

Attention is now turned to FIG. 8A which shows a schematic view of an embodiment of the present invention. A block 800 is adapted to allow for passage of infrastructure element 885 between blocks and through a final wall. Infrastructure elements may include but are not limited to electrical wiring, water or steam pipes, Internet or phone wires, cables or the like. Such elements are generally run through the floor, walls, or ceiling and as such a block 800 may be adapted through appropriate holes 880 or the like to allow for passage of infrastructure element 885. When a final wall is constructed (not shown), the holes 880 are not visible as they stand between blocks and are not visible either on the inside or the outside of the final structure.

Figure 8B:
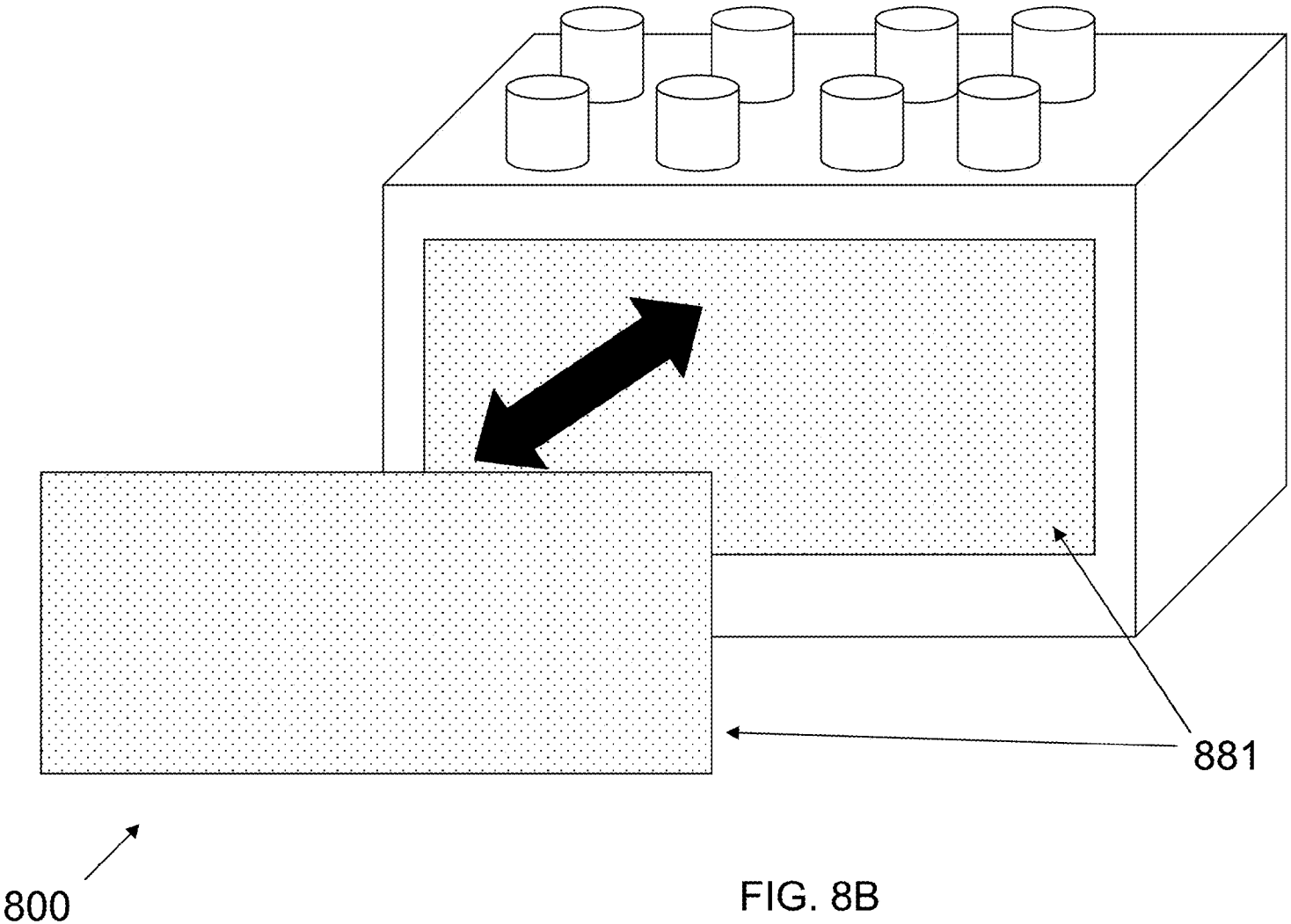

Attention is now turned to FIG. 8B which shows a schematic view of an alternative embodiment of the invention. A removable face 881 is included in a block 800 and serves to allow for insertion of pipes, wires, and other infrastructure elements (not shown in this view). The face 881 may be attached by any means including but not limited to screws or adhesive. Removal of the face 881 may require application of a vacuum to the face 881. The face 881 is transiently removed as suggested by the double-arrows. The face 881 is removed, wires, pipes, cables and the like are entered and then face 881 is replaced to its original position. It is expected that a subset of all blocks used in a construction job will require space for pipes, wires and the like and such blocks will have a capability as shown in FIGS. 8A-8B to seamlessly handle such elements.

Should floors be built by similar block methods, they too can include either holes and/or removable elements to receive wires and piping that traditionally are laid beneath floors during construction. The same would apply to ceilings built by the block methods described for the present invention.

It is understood from the embodiments of the present invention that blocks 800 may be made of any size or shape that is relevant for an appropriate construction job. Blocks may be made of various sizes and also appropriate shapes to allow for corner construction. Thus, L-shaped blocks or blocks built at 90 degrees may be used to affect corner construction within the embodiments of the present invention. Blocks may be made of any materials, including but not limited to polymers, stone, metals, wood, concrete, or composites.

Figure 9:
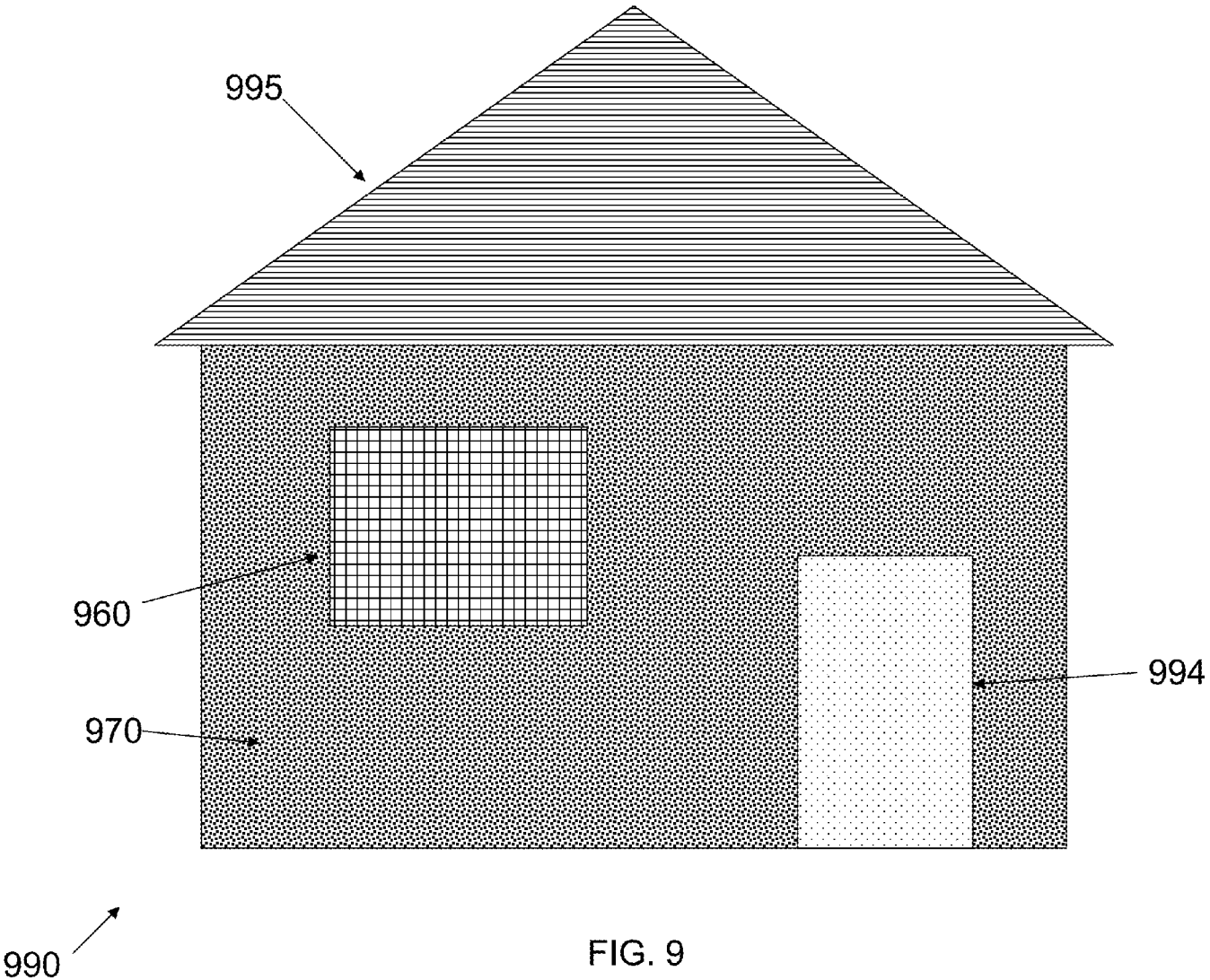
FIG. 9 shows a schematic view of a house built with blocks according to an embodiment of the present invention.

Attention is turned to FIG. 9 which shows a schematic view of a house 990 built according to an embodiment of the present invention. Blocks are used for construction of wall 905, window 960, door 990 and roof 995. The blocks selected for each element may be the same or different. The blocks are designed to allow for facile incorporation of elements such as windows, doors, and the like into larger structures such as walls based on the blocks. Of the advantages of the instant invention, there are the ease and speed with which construction is performed: blocks are brought to a building site and the blocks are appropriately assembled to yield a final structure. No mortar is required and after building, the walls and other elements are complete, with no need for further painting or treatment. The wall 905 has the outer coating 970 which is complete and ready to withstand the elements. Blocks fit well enough together to prevent wind, rain, and bugs from entering inside the structure. The first and second finishes associated with a block are complete, in the sense that they require no further treatment or modification.

Sixth Embodiment

Figure 10:
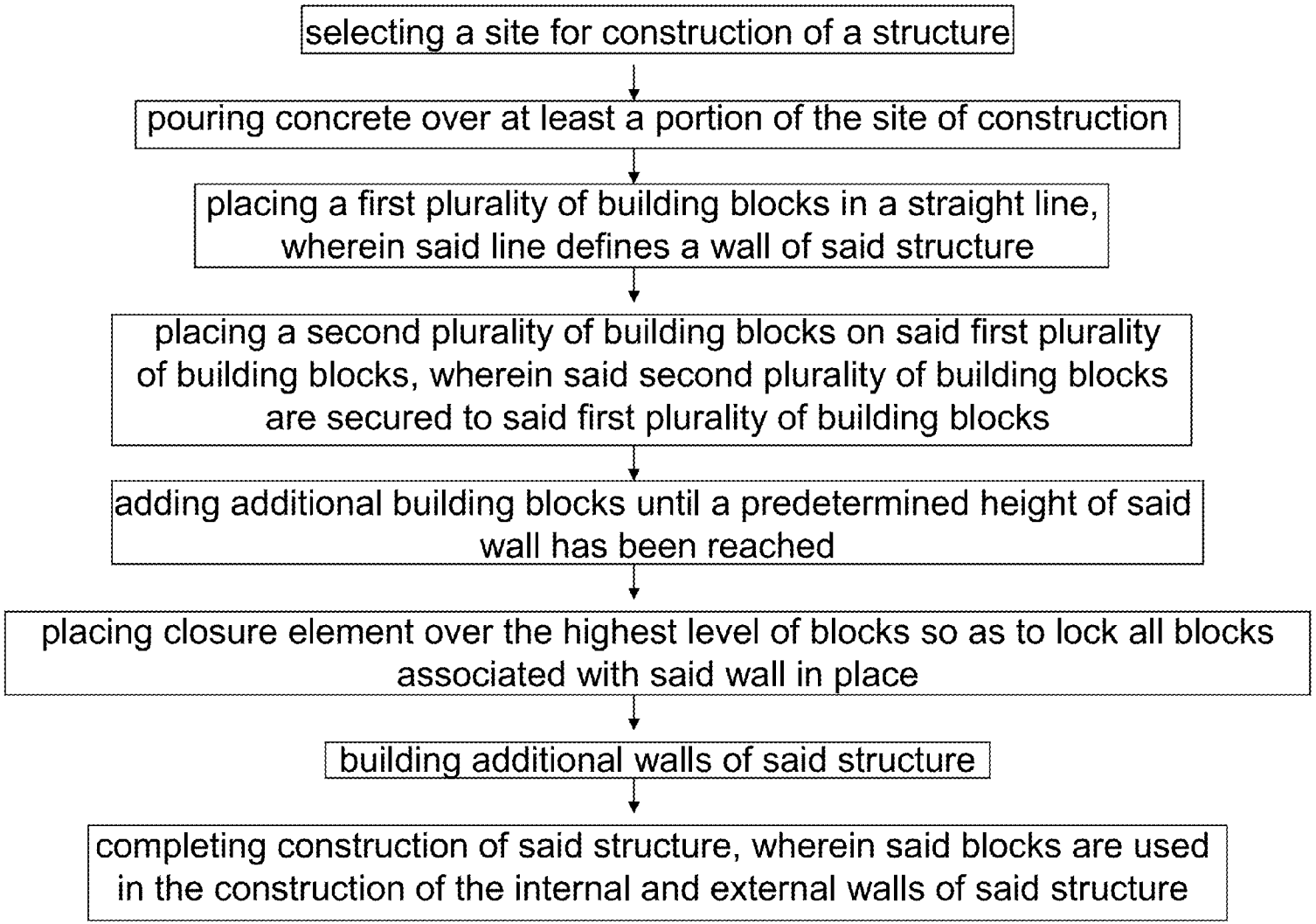
FIG. 10 shows a flowchart associated with a method of the present invention.

Attention is turned to FIG. 10 which shows a method associated with the present invention. In the method, a site is selected for construction of a structure. The structure can be private or public, large or small, of any shape, with unique finishes outside and inside. After selection of site, the site is leveled and concrete is poured over all or part of the site. Infrastructure elements such as piping for hot and cold water may be encased in the poured concrete. Above the poured concrete, walls of the structure are built, namely by first placing a plurality of building blocks in a straight line or in any shape that reflects the intended final shape of the structure. The first row of blocks is placed on the concrete (or other base material) as previously described. A second, third and additional pluralities of building blocks are sequentially placed over the first row of blocks, blocks being attached top-to-bottom and side-to-side as previously described. Additional rows of blocks are placed to the final desired height of any given wall. After a wall is completed, a closure element may be placed to secure and complete a wall. Additional walls of the structure are built in a similar manner until the structure's outer and inner walls/divisions are complete. Infrastructure elements may be run through the blocks of the wall.

It is expected that during the life of a patent maturing from this application variable mold technologies will be developed and the scope of the term of the invention is intended to include all such new technologies a priori.

As used herein the term "about" refers to ±10%.

The terms "comprises", "comprising", "includes", "including", "having" and their conjugates mean "including but not limited to".

The term "consisting of means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

All technical terms may have their normal meaning as applied to the art unless otherwise specified. "Infrastructure elements" may refer to cables, pipes, wires, and the like traditionally used in construction. Such cables, pipes, and wires may move water, telephone connections, electricity, TV connections or other items.

EXAMPLE

Blocks are produced from polymeric material from a three-dimensional printer to final dimensions of 50/60 centimeters in length, 25/30 centimeters height, and 5/10/20 centimeters in width. The blocks are hollow and have multiple holes for the passage of wires and pipes. The blocks additionally include insulation made from fiberglass. A subset of the blocks include a removable wall that allows for insertion of piping and electrical/phone cables; the removable wall is placed over the piping and cables and may be removed in order to service said piping and cables. The blocks may be used as they are produced in the production of walls of a structure or alternatively, the blocks may be painted and or treated to create unique inner and outer finishes prior to use of blocks in construction of a plurality of walls in a structure. The finishes may be bonded, glued, or otherwise associated with the blocks. A special glue may be employed to hold blocks from a ceiling structure together—blocks being connected through joining elements in the side of the blocks, and a very strong glue, 3M DP 601 as a non-limiting example of the same, to hold them in place over an open space. DP 601 is appropriate for concrete block elements, while for composite materials, 3M VHB is more appropriate for use, though it is by no means limiting.

It is expected that in some embodiments of the instant invention, blocks without any additional inner or outer coatings will be utilized. The blocks may be made from natural, synthetic, or recycled materials, and may have properties that allow for construction as herewith described, without any recourse to additional coatings beyond the block material. Natural stone or other materials may be ground up, mixed with a binder and poured into block construction—with all connector features, as well as a removable face for access to wires, cables, and the like.

It is stressed that in many embodiments of the instant invention, the base block will include at least one face that can be removed to access inner spaces of the block. Removal of the face will generally be performed with a dedicated element that includes a vacuum feature for removing said face. Said face is an integral part of a block and its removal and replacement are critical to facile building methods and easy access to wires, cables, pipes, and the like.

Critical features of buildings employing the instant invention are column-less construction and additionally floors that may be fashioned out of blocks as previously described. The blocks are load-bearing, as are the walls constructed from there. Therefore, it is intended that no columns will be required in building with the block system described herewith, and in some embodiments, in place of pouring a concrete floor as described previously, the floor itself will be made of a block arrangement connected as described for wall elements. Floors and ceilings produced from appropriate blocks will include joining elements on the side of blocks but not necessarily on both the top or bottom. Ceiling and floor pieces may be complete units connected to block-based walls.

In some embodiments, a floor is built from block elements. The floor blocks may include joining elements to join floor blocks into a single floor. Glue may also be used for holding blocks together. In some of these embodiments, the floor blocks will include male or female joining elements which allow for attachment of either wall blocks as described above or floor finishing elements. For example, if the floor blocks are joined and have exposed, upward facing male joining elements, marble floor squares (0.5 meter×0.5 meter) with complementary female joining elements on their bottom may be placed for the floor, with male and female elements joined to allow for final floor preparation. Marble floor squares are placed over the floor blocks until a complete marble floor is prepared. In such a system, there is no requirement for sand beneath the marble floor pieces and one can remove a floor piece easily. Glue may additionally be applied between floor blocks and final floor pieces such as the marble squares described herewith.

One of the advantages of embodiments of the instant invention is that heat may be passively removed through the joining elements of the blocks. Heat that passes through an inner side of the blocks may be taken up and out of a house or other structure through the connected follow joining elements.

For multi-storey structures, a cable may be run through the blocks from base to top to give added strength to block-based walls. In some embodiments, the joining elements may be of a round shape, and a closing element may be run through the joining elements to lock in groups of blocks. For example, for every four blocks stacked on top of each other, a group of closing elements may be run through the round joining elements to lock the group of blocks together. This arrangement may be in place of glue or in addition to glue. Hollow closing elements give added block/wall strength in the event of earthquakes and the like by locking blocks together through their mutual round joining elements. It is assumed that embodiments of the instant invention will be used not only to build multi-storey homes but also be applied for construction of towers of ten stories or higher. Strengthening elements may be added to or applied to blocks or block-based walls to allow for multi-storey construction. In some multi-storey structures employing blocks herewith described, the ceiling of one floor may serve as the base for block attachment and cable/wire space for the floor immediately above it for a plurality of ceiling/floor combinations.

In some embodiments of the instant invention, outside surfaces of blocks may be adapted to accept or encourage growth of plants, ivies, or the like. The surfaces may include pots or may have features that encourage natural growth of grasses, plants, trees, shrubs, flowers or the like.

Seventh Embodiment

Figure 11:
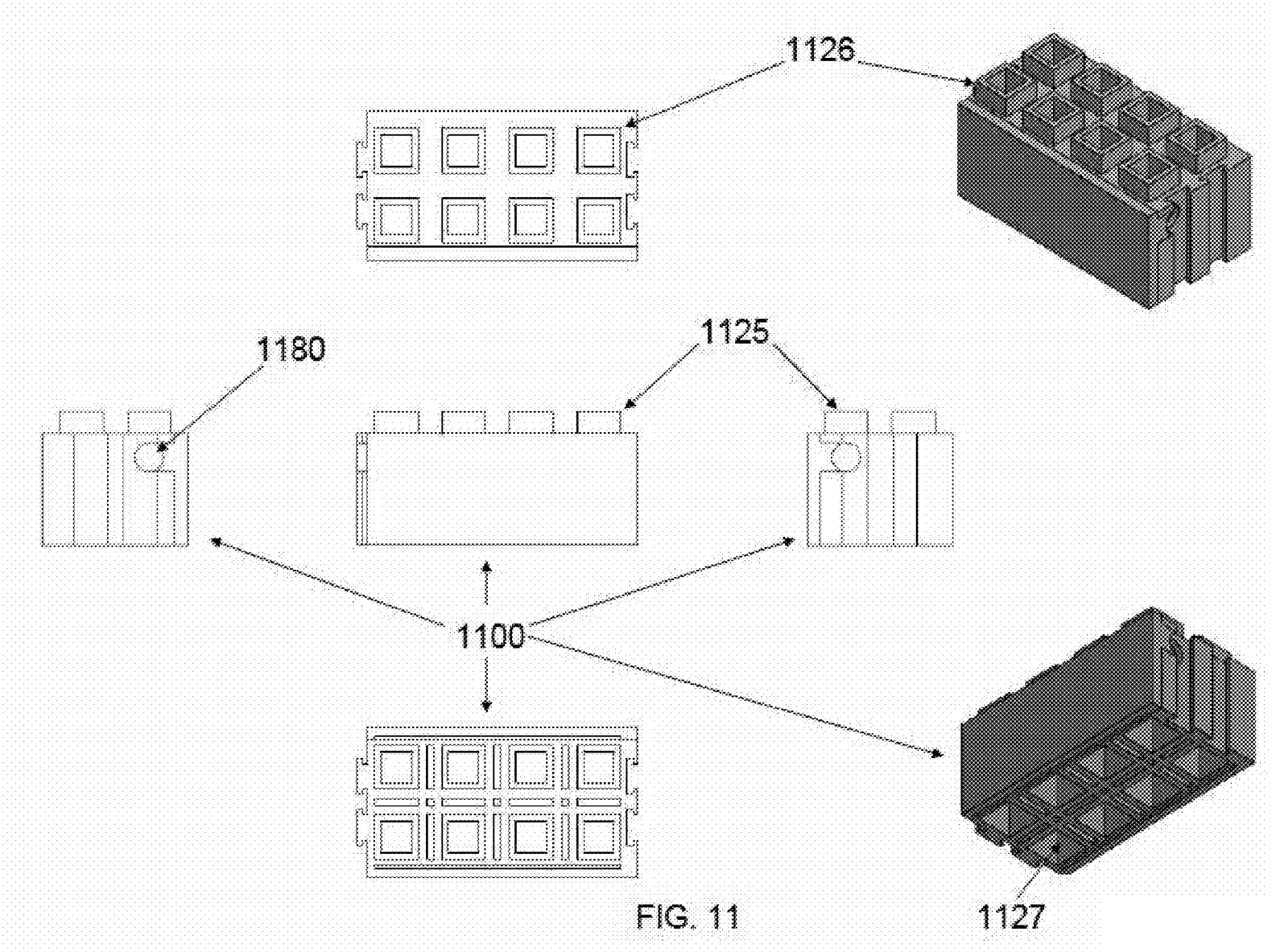
FIGS. 11-19 show various views of blocks or combinations of blocks, floors, and ceiling components according to an embodiment of the instant invention; and, FIG. 20 which shows a schematic view of an embodiment of the instant invention.
Figure 12:
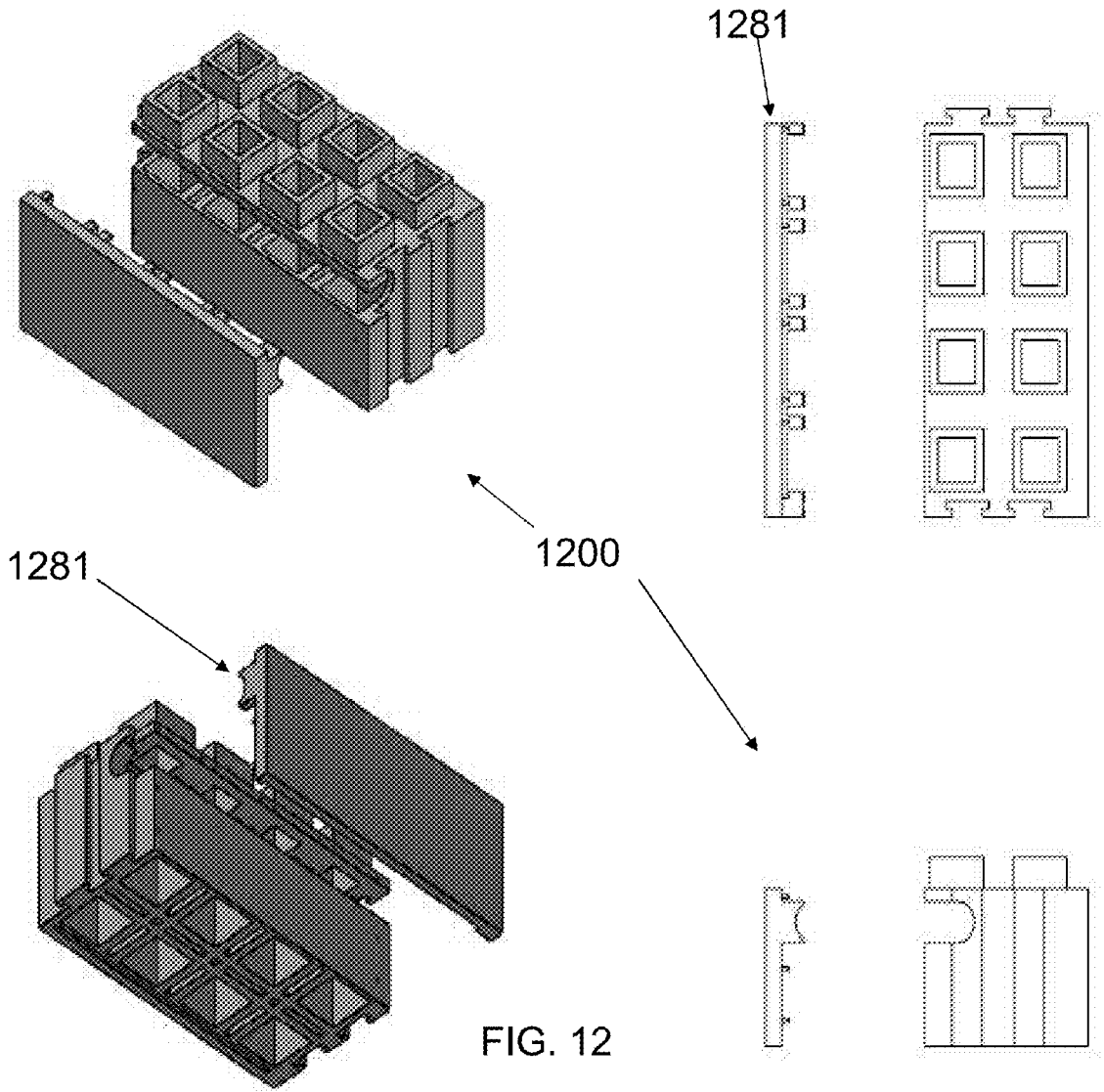

Attention is turned to FIG. 11 which shows a block 1100 according to an embodiment of the instant invention. FIG. 11 shows various angles of view of the block 1100 which includes joining elements 1125 and passage space 1180 for infrastructure elements. Protruding 1126 and receding 1127 elements are used in joining blocks securely. FIG. 12 shows the removable face 1281 attached and removed from the block 1200. Removing face 1281 allows for facile introduction or care of infrastructure elements (not shown for reasons of clarity).

Figure 13:
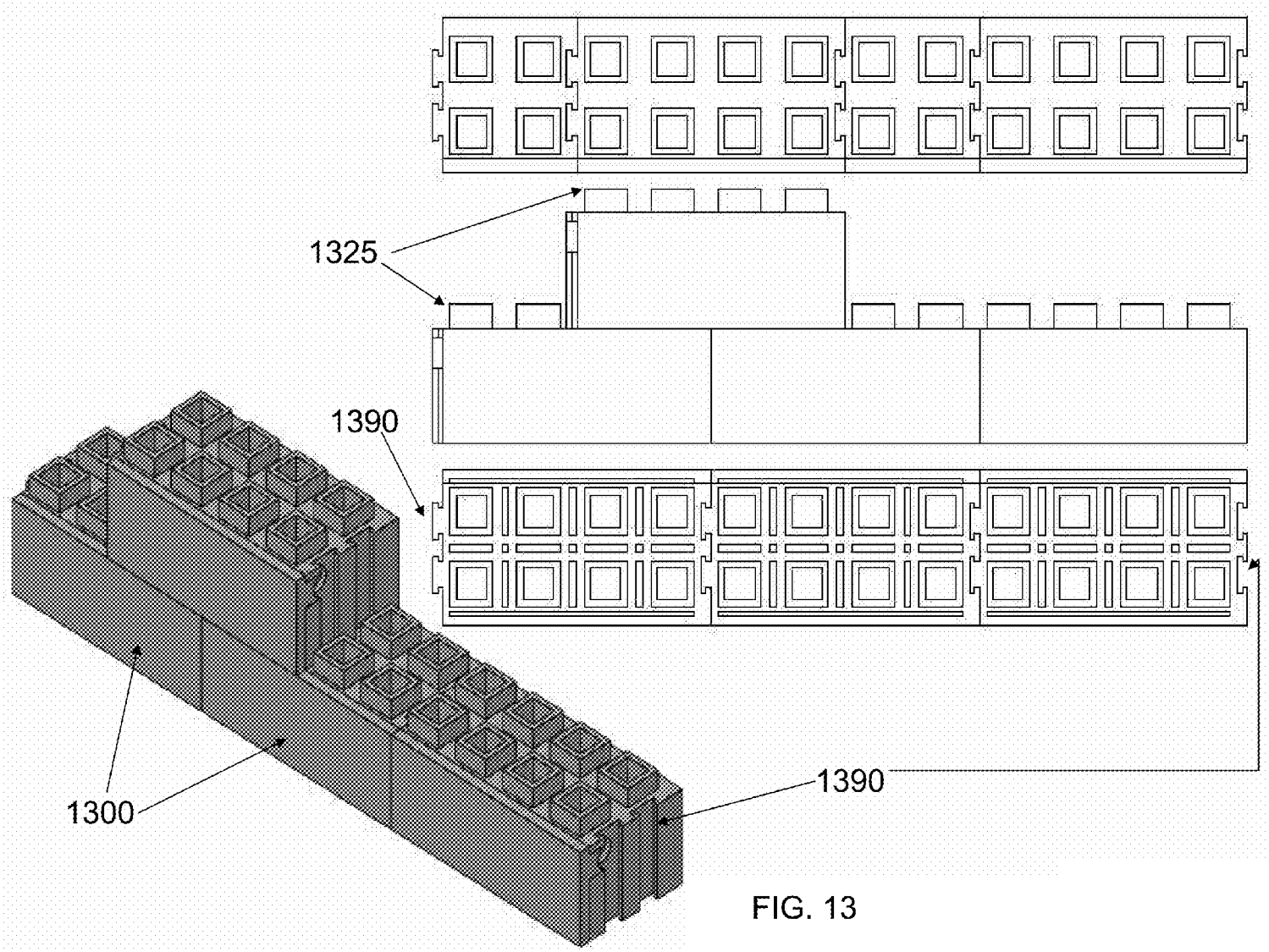
Figure 14:
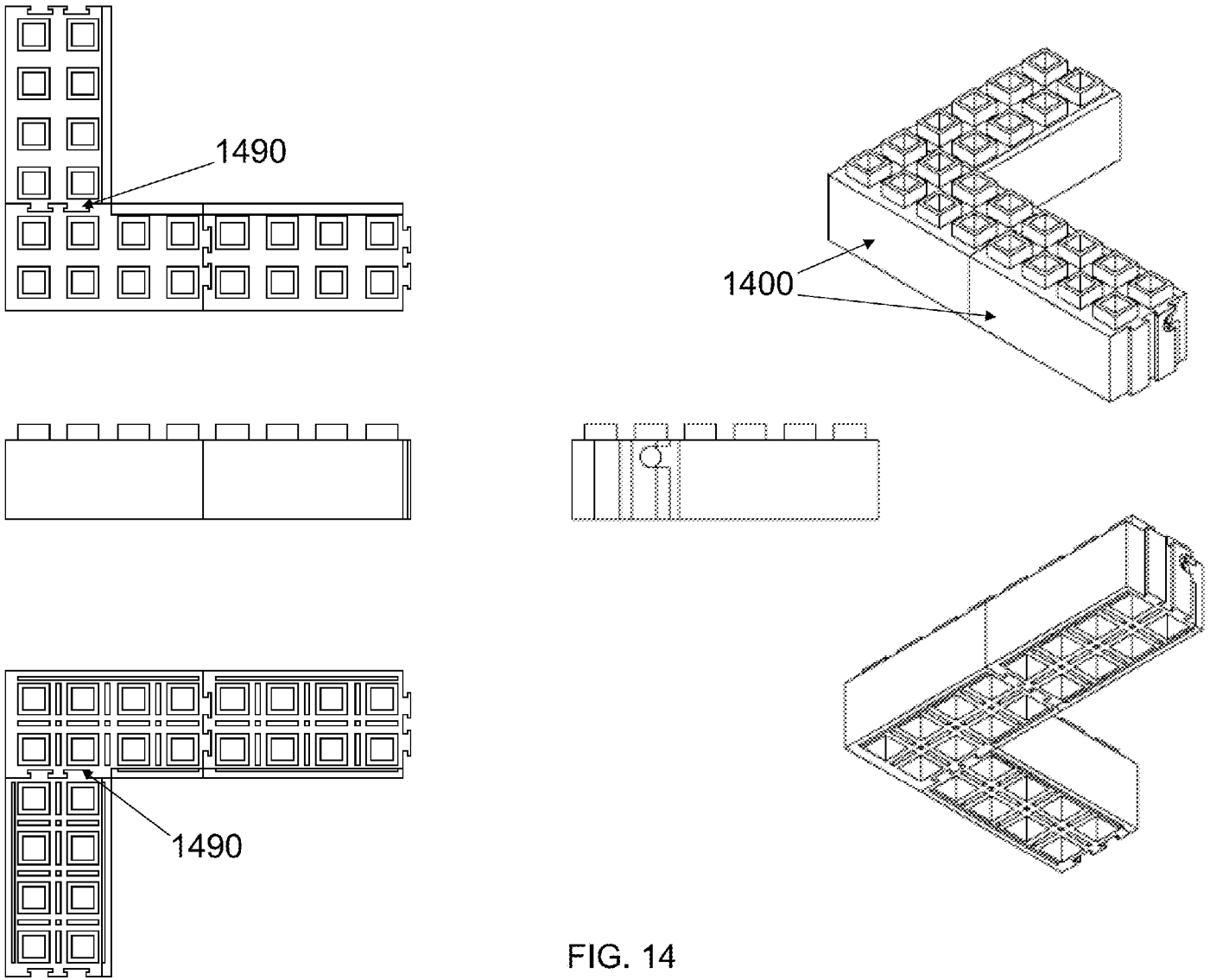

FIG. 13 shows a plurality of blocks 1300 joined together, both side to side and top to bottom. Connectors 1390 are used for aligning and joining adjacent blocks 1300 while joining elements 1325 are involved in top-to-bottom attachment of blocks to form higher structures. Each block 1300 includes a set of male and female connectors 1390 on opposite sides to allow for facile joining of consecutive blocks 1300 in a row. Additional materials such an adhesive (not shown) may be applied between blocks side-to-side and top-to-bottom. FIG. 14 shows a corner arrangement in which blocks 1400 are joined through connectors 1490 specifically designed to accept blocks at 90 degrees, as shown.

Figure 15:
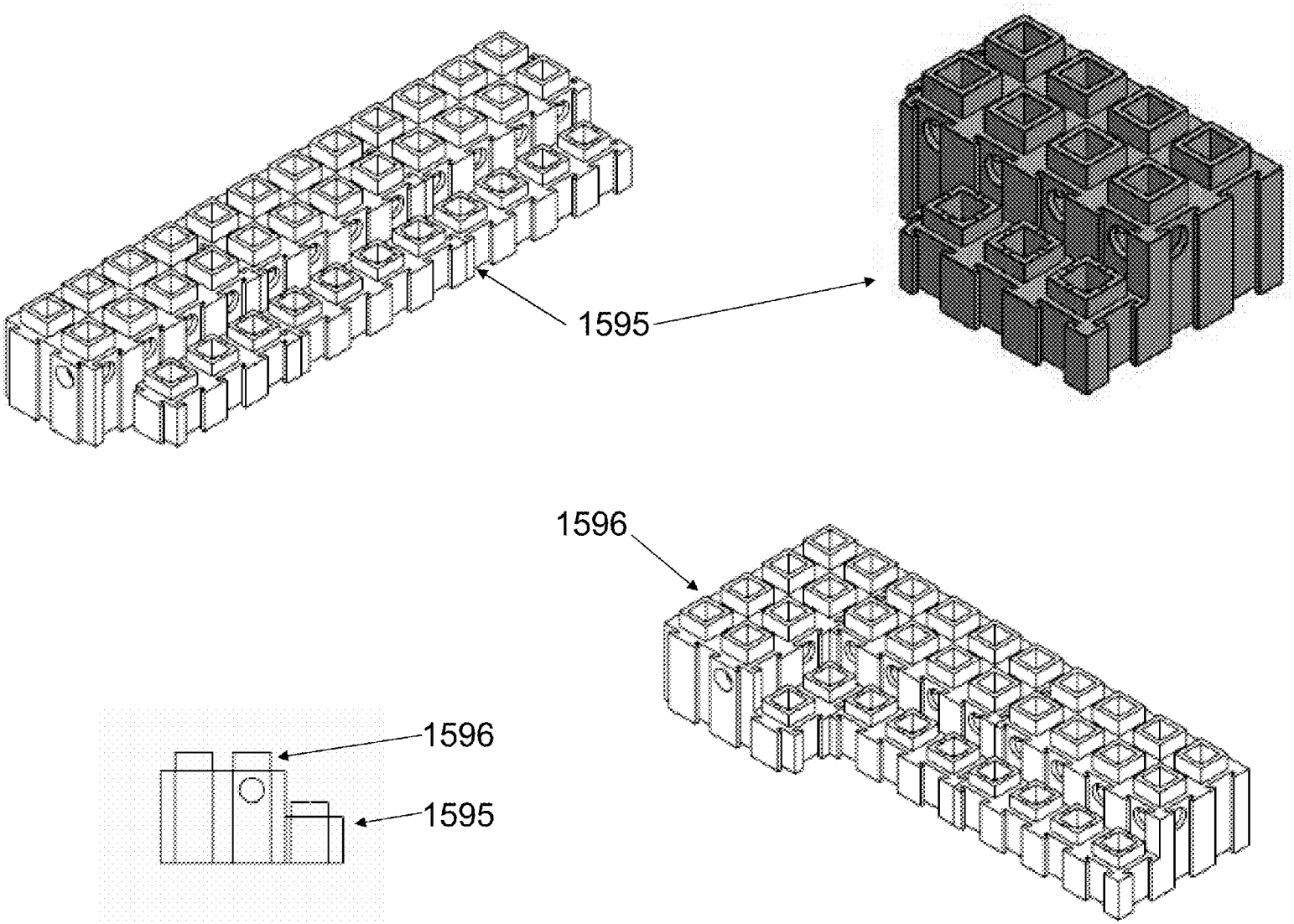
Figure 16:
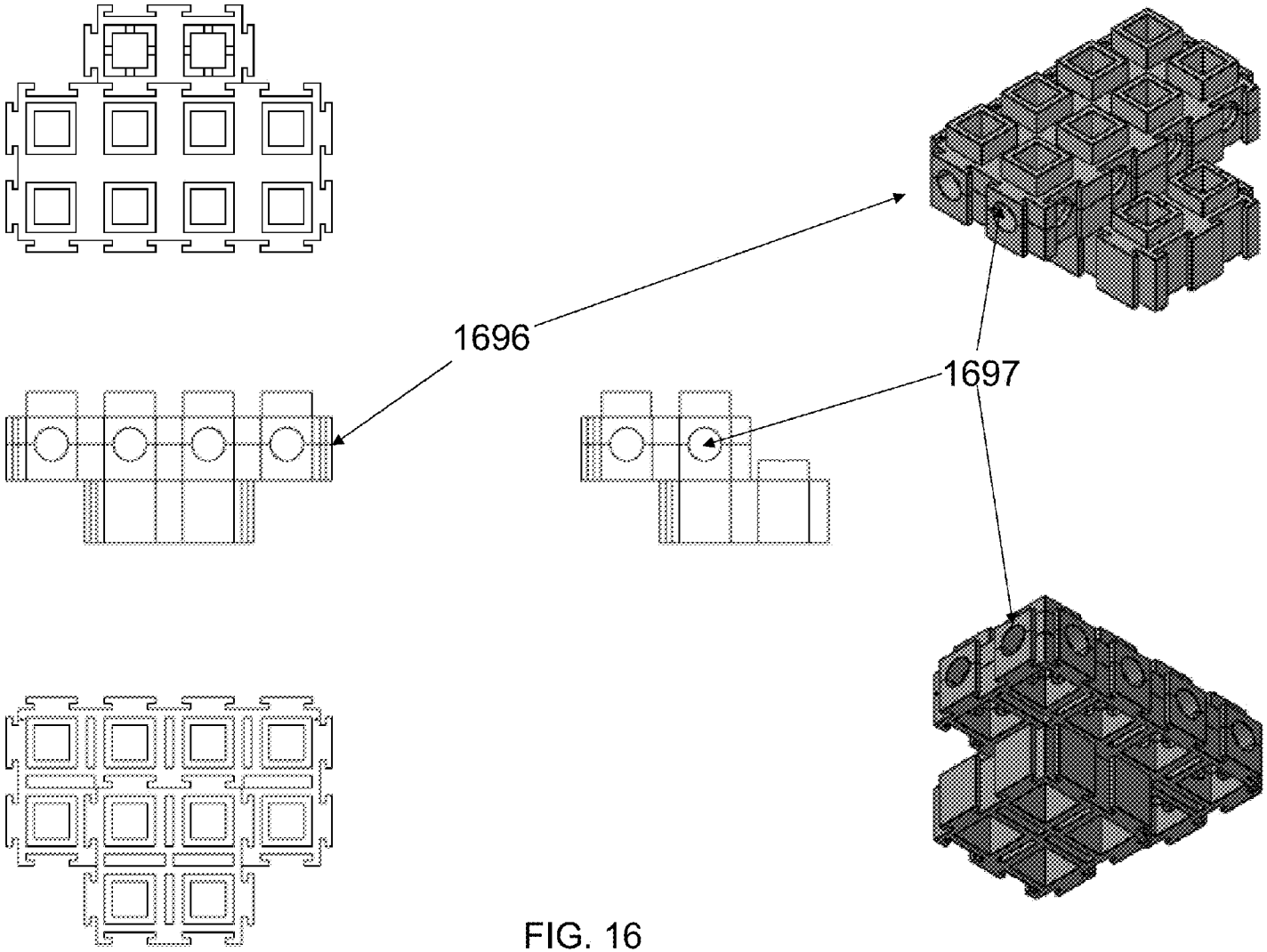
Figure 17:
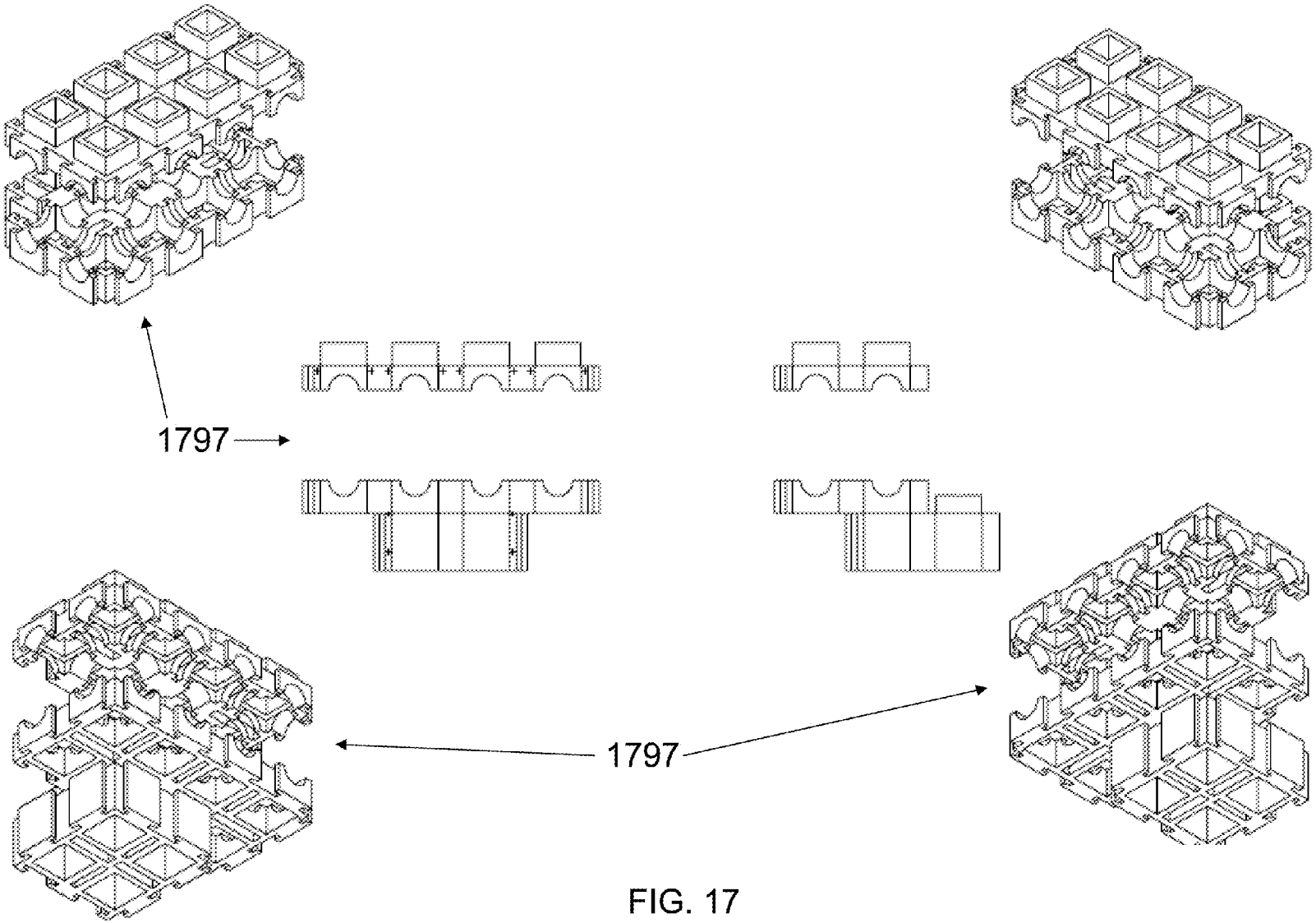

Attention is turned to FIG. 15 which shows a ceiling/floor arrangement. Ceiling block 1595 includes the floor 1596 for the storey immediately above said ceiling 1595. The floor 1596 allows for placement of marble or other finishing pieces as well as next level of blocks (not shown). FIG. 16 shows floor 1696 with plurality of holes 1697 for passing infrastructure elements through the floor 1696. Water pipes, electrical wires, and other critical building elements may be run through the floor 1696 through the agencies of the prepared holes 1697 in the floor 1696 elements. FIG. 17 shows the floor 1797 open to accommodate infrastructure and other elements.

Figure 18:
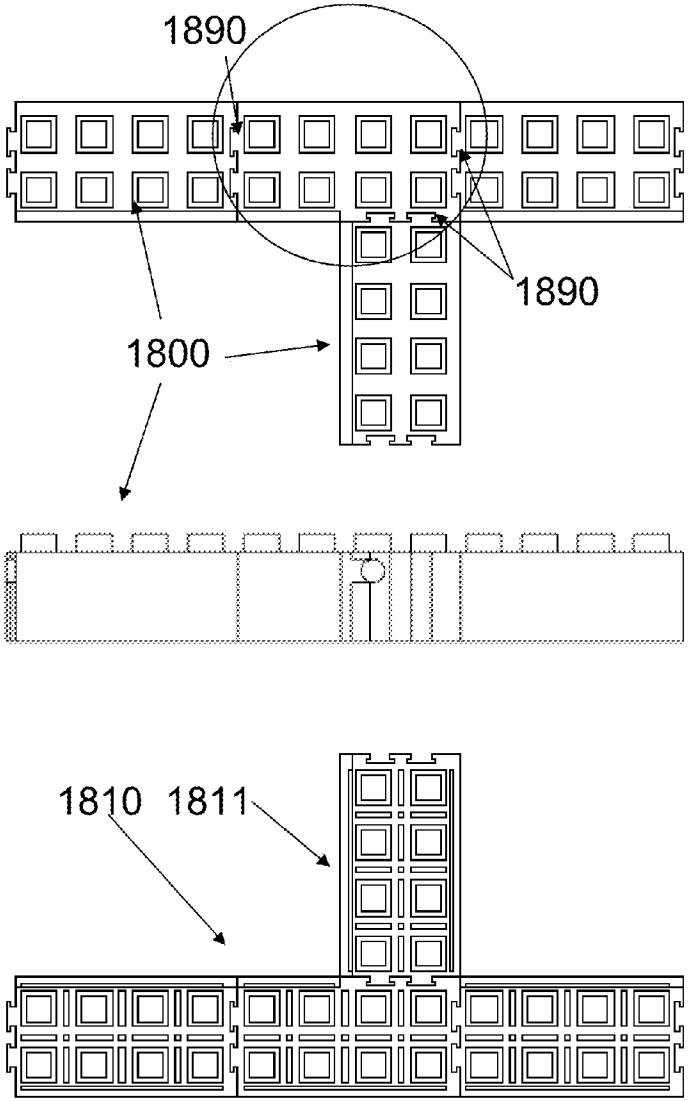

Attention is turned to FIG. 18 which shows an internal wall 1811 developed from an external wall 1810. The block 1800 shown in the circle includes three sets of connectors 1890: two at the end for continuing the external wall 1810 and one set for starting the internal wall 1811. This arrangement allows for building internal walls 1811 at will and thus partitioning of a larger structure into functional rooms and spaces.

Figure 19:
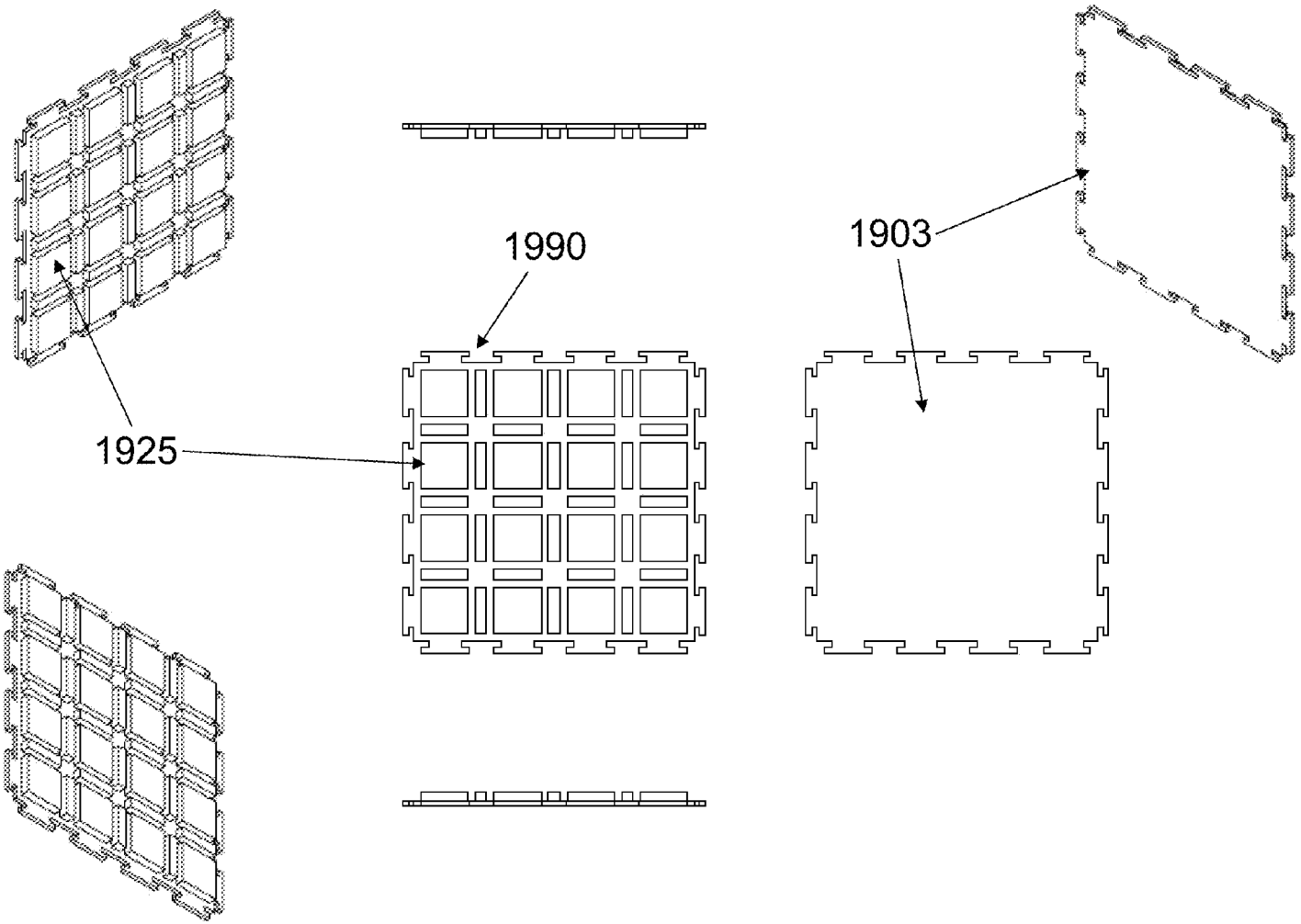

FIG. 19 shows flagstones 1903 according to an embodiment of the present invention. The flagstones 1903 may be placed with associated joining element 1925 onto blocks used for a floor (not shown). Connectors 1990 are used for joining a plurality of flagstones 1903.

Eighth Embodiment

Figure 20:
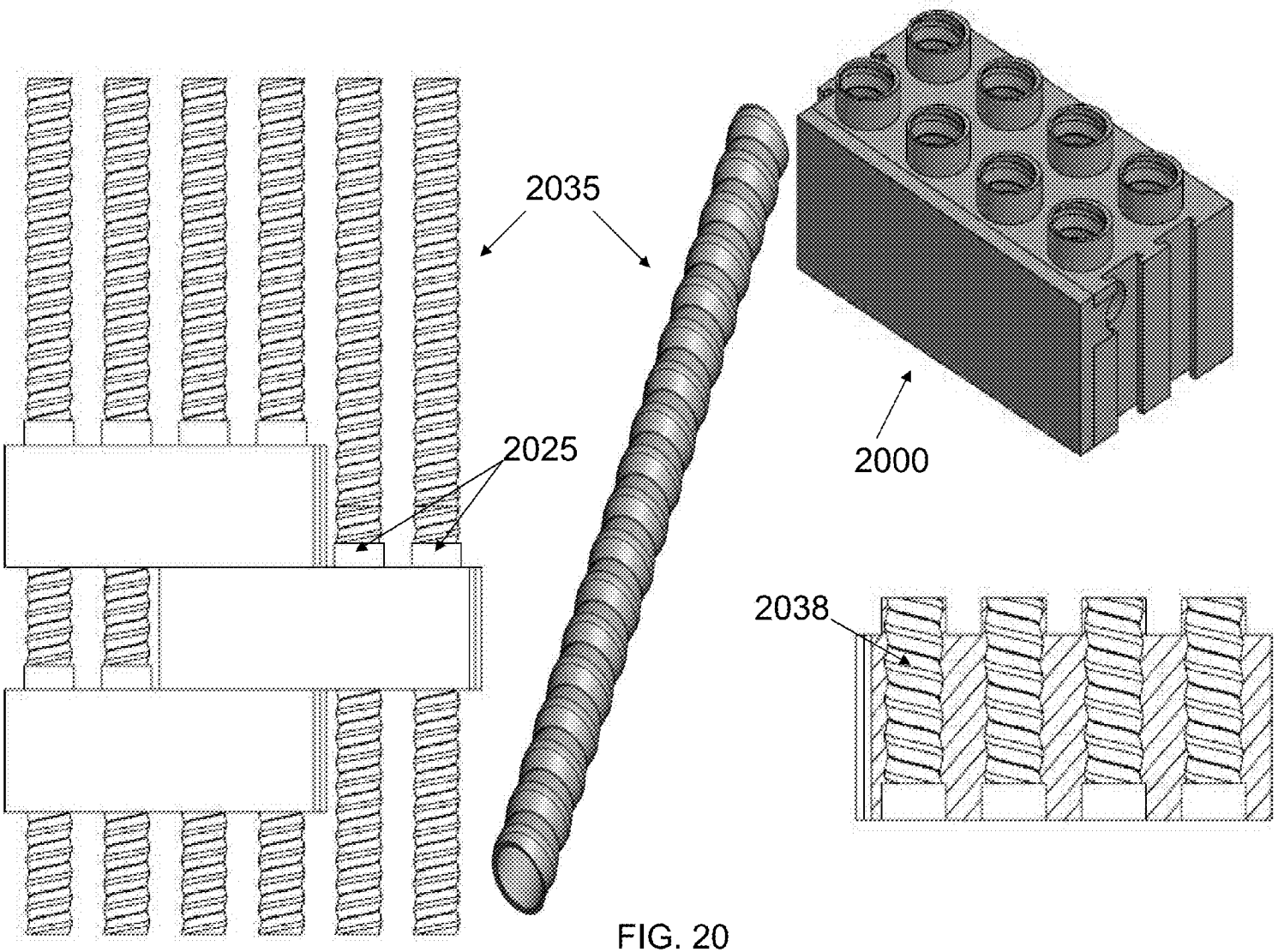

Attention is turned to FIG. 20, which shows a block 2000 according to an embodiment of the instant invention. The embodiment includes a closing element 2035 which fits into joining elements 2025 so as to allow for more solid connection between blocks 2000 stacked upon each other. The closing element 2035 may be made of any material including but not limited to polymers and metals. The closing element 2035 may include a groove 2038 which allows for screwing the closing element 2035 tightly into stacked blocks 2000.

It is understood that while many of the figures associated with the present invention show a "block" shaped structure, the instant invention may use blocks of any material, shape, size, and feature. Thus, rounded or curved blocks, arch-shaped blocks, or other shapes are all possible with varying embodiments and versions of elements of the present invention. It is also understood that blocks similar to those herewith described may be used in other forms of building, such as but not limited to ship and plane construction, car building, and other forms of manufacture that require some type of construction of larger structures from smaller building blocks.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination. Insulation, electronic components or other items may be included in the inside our outside of a block. Additionally, one could paint or otherwise treat a block after building, should he/she wish. Such additional treatment would not be required but could be done. In some embodiments, an entire built structure—walls, floor, roof, etc. will be made from various forms of blocks as described herewith; there will be no need for other building elements beyond windows and doors which will be fitted into the structure created by the whole-block construction.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. The present invention could be employed for production of wide variety of "building blocks" of non-rectangular shapes and for uses beyond traditional building.

Various embodiments and aspects of the present invention as delineated hereinabove and as claimed in the claims section below find experimental support in the following example.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

The invention claimed is:

1. A substantially hollow block for use in building construction including floors, walls, and ceilings of said building, wherein said block has a top side that includes a first joining feature, a bottom side including a complementary second joining feature, a plurality of connectors and holes at the ends of said block, extending continuously through the length of said block, and an inner space closed by a removable face, said space adapted to accept infrastructure elements of at least one of electrical wiring, water pipes, steam pipes, Internet wires, phone wires, and cables, and said holes are adapted to allow facile passage of said infrastructure elements to adjacent blocks wherein said infrastructure elements may be inserted after completion of the building through said removable face.

2. The block according to claim 1, wherein said first joining feature is a plurality of joining features, and wherein said second joining feature is a plurality of joining features.

3. The block according to claim 2, wherein said joining features include at least one strip of two-side tape on a top side of said block.

4. The block according to claim 1, wherein said substantially hollow block includes a second removable face.

5. The block according to claim 1, wherein said building is a house, room, office, factory, school, hospital, public structure, sky scraper or private building or room.

6. The block according to claim 1, further including insulation and energy saving materials placed inside said space.

7. The block according to claim 1, wherein said removable face may be replaced with a different removable face in order to change an appearance of the floor, wall, or ceiling said block is contained within.

8. The block according to claim 1, wherein said first finish is weatherproofed and selected from paint, wood, brick, aluminum siding, stone, glass, composite materials, metal.

9. The block according to claim 1, wherein said second finish is adapted to be removed and is selected from paint, wallpaper, stone, wood, brick, aluminum, glass, metal, composite materials, or drywall.

10. The block according to claim 1, further including pins to aid in the alignment of a first substantially hollow block with a second substantially hollow block.

11. The block according to claim 1, wherein said face is transiently removed by the aid of a vacuum.

12. A building block for mortar-less and paint-less construction, wherein said block is made of a pre-painted polymeric material and includes a plurality of elements for self-joining with other such building blocks as well as at least one removable a face that can be removed for access to infrastructure elements of at least one of electrical wiring, water pipes, steam pipes, Internet wires, phone wires, and cables, running through said building block, wherein said building block includes a plurality of holes at the ends of said block and at the top and the bottom of said block for transfer of infrastructure elements between adjacent blocks and wherein said infrastructure elements may be inserted after completion of the building through said at least one removable face.

13. The building block according to claim 12, wherein said building block includes spaces for passing through electrical wiring, pipes, tubes, cables and telephone cables.

14. The building block according to claim 12, wherein said elements for self-joining allow for contact between blocks, wherein said contact does not allow for passage of wind or rain.

15. The building block according to claim 12, wherein said block includes at least one male and at least one female joining element as well as one connector at each end.

16. The building block according to claim 12, wherein said building block is used for the construction of walls, floors, ceilings, and roof of a multistory column-free home.

17. A block system for construction of a structure, including the following:

a plurality of building blocks, said blocks prepared from polymeric materials and including a removable face for access to a hollow space for passage of infrastructure elements of at least one of electrical wiring, water pipes, steam pipes, Internet wires, phone wires, and cables, and holes at the ends, top and bottom of said block for passage of said infrastructure elements between adjacent blocks during one of construction of said structure or after the completion of the building through said removable face;

a closing element, wherein said closing element is adapted to fit within joining elements associated with a plurality of said building blocks stacked upon each other; and, glue, wherein said glue is applied between adjacent building blocks to hold together said building blocks.

* * * * *